US006668969B2

(12) United States Patent
Meyer et al.

(10) Patent No.: US 6,668,969 B2
(45) Date of Patent: Dec. 30, 2003

(54) MANIFOLD FOR A HORN LOUDSPEAKER AND METHOD

(75) Inventors: John D. Meyer, Berkeley, CA (US); Perrin Meyer, Albany, CA (US); Richard D. Herr, Berkeley, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 0 days.

(21) Appl. No.: 10/044,810

(22) Filed: Jan. 11, 2002

(65) Prior Publication Data

US 2003/0132056 A1 Jul. 17, 2003

(51) Int. Cl.[7] ..... H04R 1/24
(52) U.S. Cl. ..... 181/177; 181/159; 181/187
(58) Field of Search ..... 181/152, 144, 181/147, 159, 185, 155, 199, 187, 192

(56) References Cited

U.S. PATENT DOCUMENTS 1,871,243 A * 8/1932 Smythe ..... 181/187
2,089,391 A * 8/1937 Marion ..... 181/188
4,152,552 A * 5/1979 Meyer ..... 381/340
4,629,029 A 12/1986 Gunness
5,163,167 A 11/1992 Heil
5,359,158 A * 10/1994 Queen ..... 181/150
5,398,992 A 3/1995 Daniels
5,526,456 A * 6/1996 Heinz ..... 381/340
5,925,856 A 7/1999 Meyer et al.
6,095,279 A 8/2000 Adamson
6,112,847 A 9/2000 Lehman

* cited by examiner

*Primary Examiner*—Robert Nappi
*Assistant Examiner*—David Warren
(74) *Attorney, Agent, or Firm*—Donald L. Beeson

(57) ABSTRACT

A manifold for a horn loudspeaker has an input end having at least one input port for receiving acoustic power from at least one acoustic driver, and an output end for delivering acoustic power to the throat end of the horn. The output end of the manifold has at least two and suitably multiple output ports. An acoustic power waveguide is provided for each output port and connects each of the output ports to the input port of the manifold. Acoustic power received by the input port is divided between the acoustic waveguides such that it is delivered to the aligned output ports to simulate a line array of acoustic power sources.

44 Claims, 17 Drawing Sheets

MANIFOLD FOR A HORN LOUDSPEAKER AND METHOD

CROSS-REFERENCE TO RELATED APPLICATIONS

Applicants claim the benefit of provisional application No. 261,113, filed Jan. 11, 2001

BACKGROUND OF THE INVENTION

The present invention generally relates to horn loudspeaker systems and more particularly to manifolds for coupling one or more acoustic drivers to a loudspeaker horn. The invention still further relates to improvements in the horn and horn manifold of a horn loudspeaker system which improve the directional characteristics of the loudspeaker without introducing significant distortion. The invention is particularly useful in arraying horn loudspeaker systems to achieve desired coverage while avoiding undesirable interactions between the horns.

To optimize a horn speaker system array, it is often desirable to control the dispersion characteristics of the horn such that the dispersion is narrow in the direction of the array and wide in the direction perpendicular to the array. Thus, in the case of a vertical stack of horn loudspeakers, destructive interaction between the acoustic output from the individual horns is minimized by controlling vertical dispersion. At the same time broad horizontal coverage is maintained for achieving desired audience coverage.

The existing approaches to horn loudspeaker design involve coupling the output of an acoustic driver to the throat end of a horn wherein the dispersion characteristics of the horn are governed by the horn design itself. Improved horn designs have been devised to achieve improved control over the directivity of a horn over a broad range of frequencies. Such a loudspeaker horn is disclosed in U.S. Pat. No. 5,925,856 issued to John D. Meyer et al., wherein a loudspeaker horn is provided with a special rectangular throat geometry and pre-load chamber for achieving uniform frequency response and coverage characteristics with low distortion. Such designs, however, are limited in their ability to achieve a suitably narrow dispersion that would permit an optimal array of the horns.

Another prior art approach to coupling drivers to a loudspeaker horn is disclosed in U.S. Pat. No. 4,629,029 issued to David W. Gunness. This patent discloses a manifold for connecting multiple drivers to the throat end of a horn so as to increase the acoustic power delivered by the horn. Again, such arrangements are limited by the horn's directional control properties. Generally, highly directional horns can be achieved with long, slow, expanding horns, but even here the dispersion of the horn has a practical upper limit of about 20 degrees. Such long horn lengths are undesirable since distortion produced by the horn increases by the number of wavelengths over which the sound pressure waves are confined in the horn.

The present invention overcomes the inherent limitations of existing loudspeaker horn designs by providing a loudspeaker system and a manifold for a loudspeaker system which greatly improves the designer's ability to control the dispersion characteristics of the horn. More specifically, the present invention provides a horn loudspeaker system and horn manifold which permits a horn to be driven by one or more acoustic drivers in a manner which achieves a narrow dispersion characteristic in one direction and a wide dispersion characteristic in the other to permit the loudspeakers to be arrayed easily without destructive interaction between their acoustic outputs.

SUMMARY OF THE INVENTION

The invention involves a horn loudspeaker system wherein one or more acoustic drivers are coupled to the throat end of a horn having an elongated throat opening. At least one acoustic driver of a loudspeaker system is coupled to the horn's elongated throat opening by means of a manifold having an input end with at least one input port and an output end with at least two and suitably multiple aligned output ports. The aligned output ports of the manifold are connected to the input port by separate acoustic power waveguides. The acoustic power introduced to the input port of the manifold is divided between and passes through these waveguides so as to emerge from the manifold output ports as a virtual line array of acoustic power sources which are presented to the elongated throat opening of the horn. The manifold waveguides preferably have approximately equal acoustic path lengths such that the acoustical waves of the acoustic power divided between the waveguides arrives approximately in phase at the aligned output ports of the manifold.

For a horn whose elongated throat opening is oriented vertically, the manifold provides a vertical line array of output ports to simulate a vertical column of individual acoustic power sources in the throat of the horn. These individual acoustic power sources interact in accordance with well-known line array theory to control vertical dispersion from the line array. Thus, the vertical dispersion characteristics of the horn connected to the manifold are mainly governed by the line array characteristics of the horn's elongated throat opening instead of by the design characteristics of the horn itself. The horn provides an additional element of directional control, and acts to block any side lobes that may be generated at the horn's throat end by physical separation of the output ports of the driver manifolds.

In a further aspect of the invention, the length of each waveguide of the driver manifolds is relatively short in length in relation to the wavelength of the acoustical waves passing through the manifold at the highest frequency at which the horn loudspeaker system is intended to operate. Preferably, the manifold waveguides have acoustic path lengths no longer than approximately three wavelengths at the highest operating frequency. Suitably, for a horn loudspeaker system having upper frequency range of 15,000 Hz, the length of the manifold would be in the range of 3 inches. Manifolds substantially exceeding 3 inches in length would produce relatively long acoustical path lengths between the input port and aligned output ports of the manifold at high frequencies, resulting in increased distortion in the sound pressure wave as it passes through the waveguides. On the other hand, in manifolds substantially shorter than 3 inches in length, the bends in the waveguides used to equalize acoustical path lengths would increase to the point where the bends would produce excessive reflections within the manifold.

In still a further aspect of the invention, each of the manifold waveguides increases in cross-sectional area from the input port of the manifold to the output port of each waveguide. Such expansion acts to further reduce the distortion effects the waveguide has on the acoustic sound waves as they pass through the manifold.

The invention also involves a method for providing control over the dispersion characteristics of a horn loudspeaker which includes providing both a source of acoustic power and a loudspeaker horn with an elongated throat opening, dividing the acoustic power produced by the acoustic power source between at least two acoustical paths, and propagating the divided acoustic power along the at least two acoustical paths to two separate aligned outputs at the elongated throat opening of the horn so as to simulate a line array of acoustic power sources at the elongated throat opening.

Therefore, it is a primary object of the invention to provide a manifold for a loudspeaker horn and a method of driving a loudspeaker horn which permits tighter control over the dispersion characteristics of a horn loudspeaker system. It is another object of the invention to provide a horn loudspeaker system which can be readily arrayed without destructive interaction between the acoustic outputs of the loudspeakers. It is a further object of the invention to provide a horn loudspeaker system and method with the foregoing advantages which can minimize distortion. Yet Other objects of the invention will be apparent from the following description and claims.

DESCRIPTION OF THE ILLUSTRATED EMBODIMENT

Figure 1:
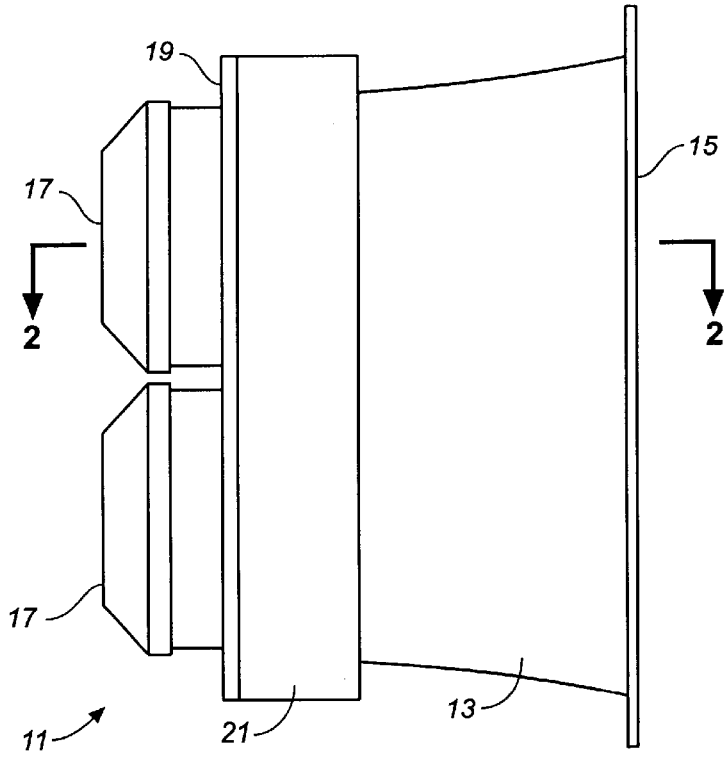
FIG. 1 is a side elevational view of a horn loudspeaker system in accordance with the invention using two closely spaced compression drivers.
Figure 2:
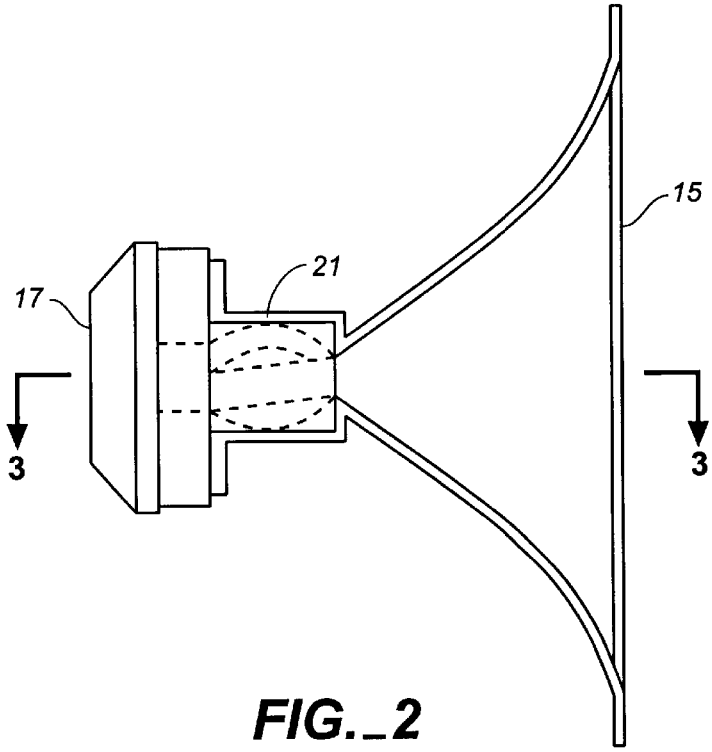
FIG. 2 is a cross-sectional view thereof taken along lines 2—2 in FIG. 1.
Figure 3:
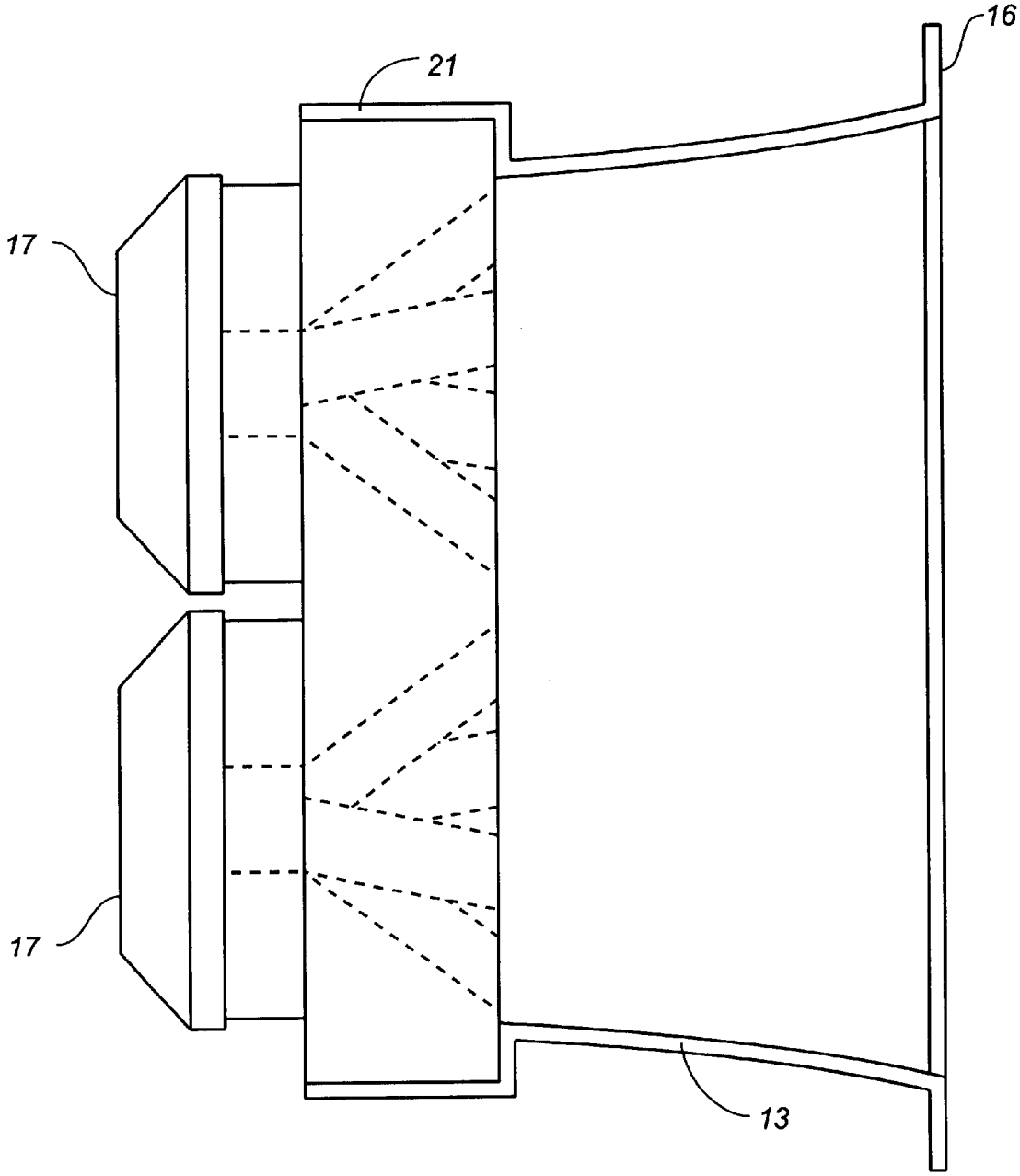
FIG. 3 is a cross-sectional view thereof taken along lines 3—3 in FIG. 2.

Referring to FIGS. 1–3 of the drawings, a horn loudspeaker system 11 includes a horn 13 having mouth end 15 and two closely spaced compression drivers 17 mounted to the horn's back end 19. The back end of the horn has an enlarged manifold mounting chamber 21 for holding the driver manifold hereinafter described. The placement of the driver manifold in mounting cavity 21 is illustrated in FIGS. 2 and 3, where a manifold is indicated by a phantom line representation of the acoustic power waveguides of a two driver manifold as hereinafter described.

Figure 4:
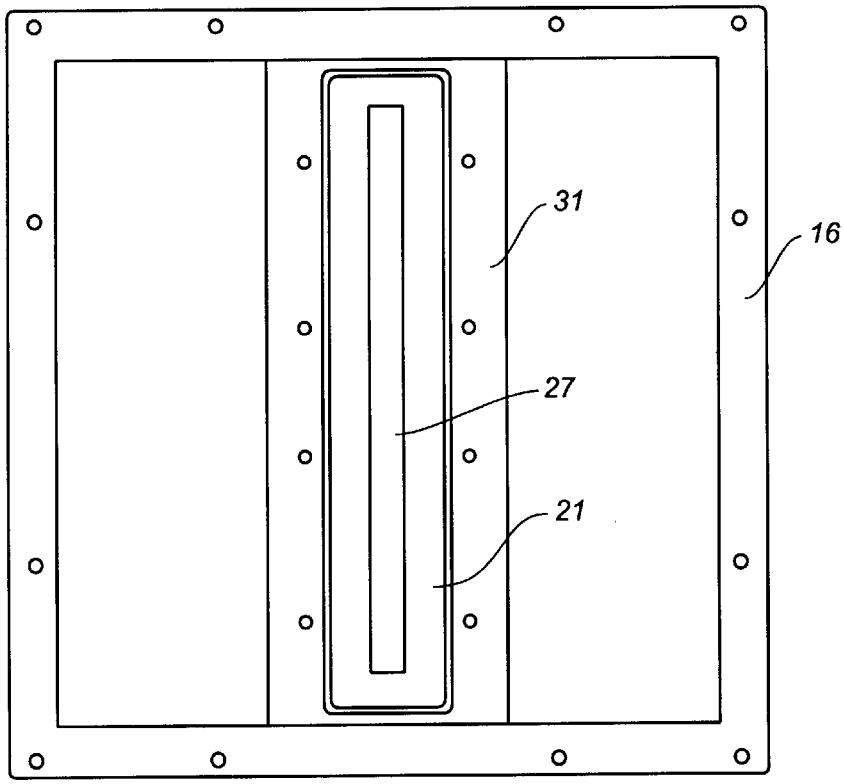
FIG. 4 is a front elevational view of the horn of the horn loudspeaker system shown in FIGS. 1–3.
Figure 5:
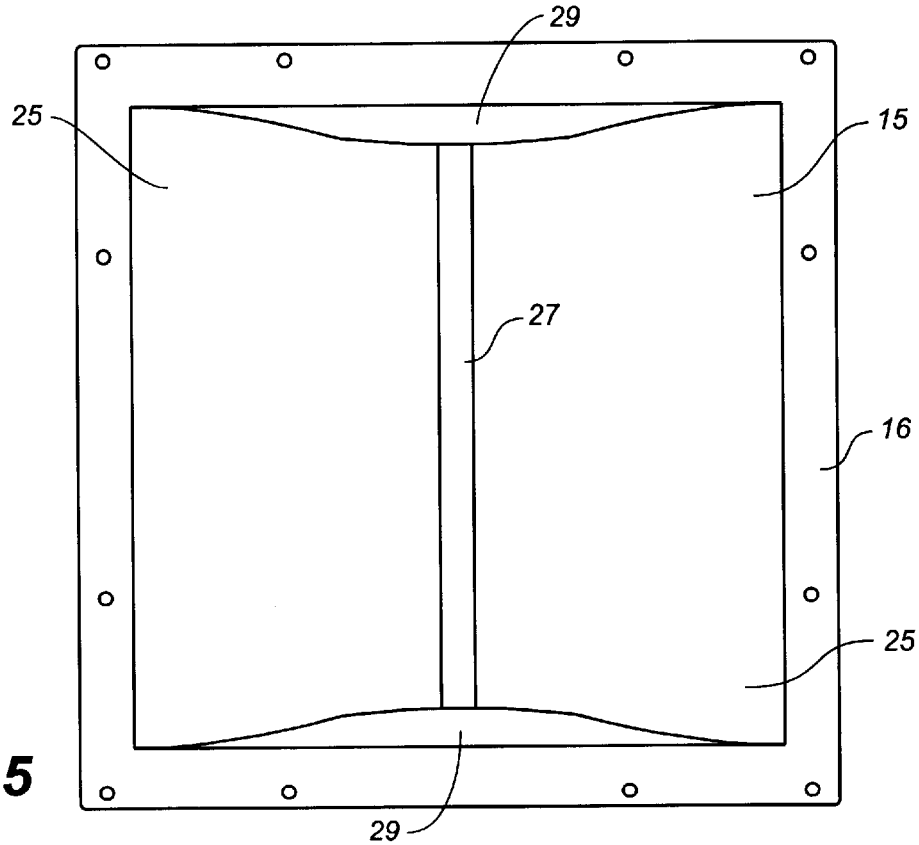
FIG. 5 is a rear elevational view thereof.
Figure 6:
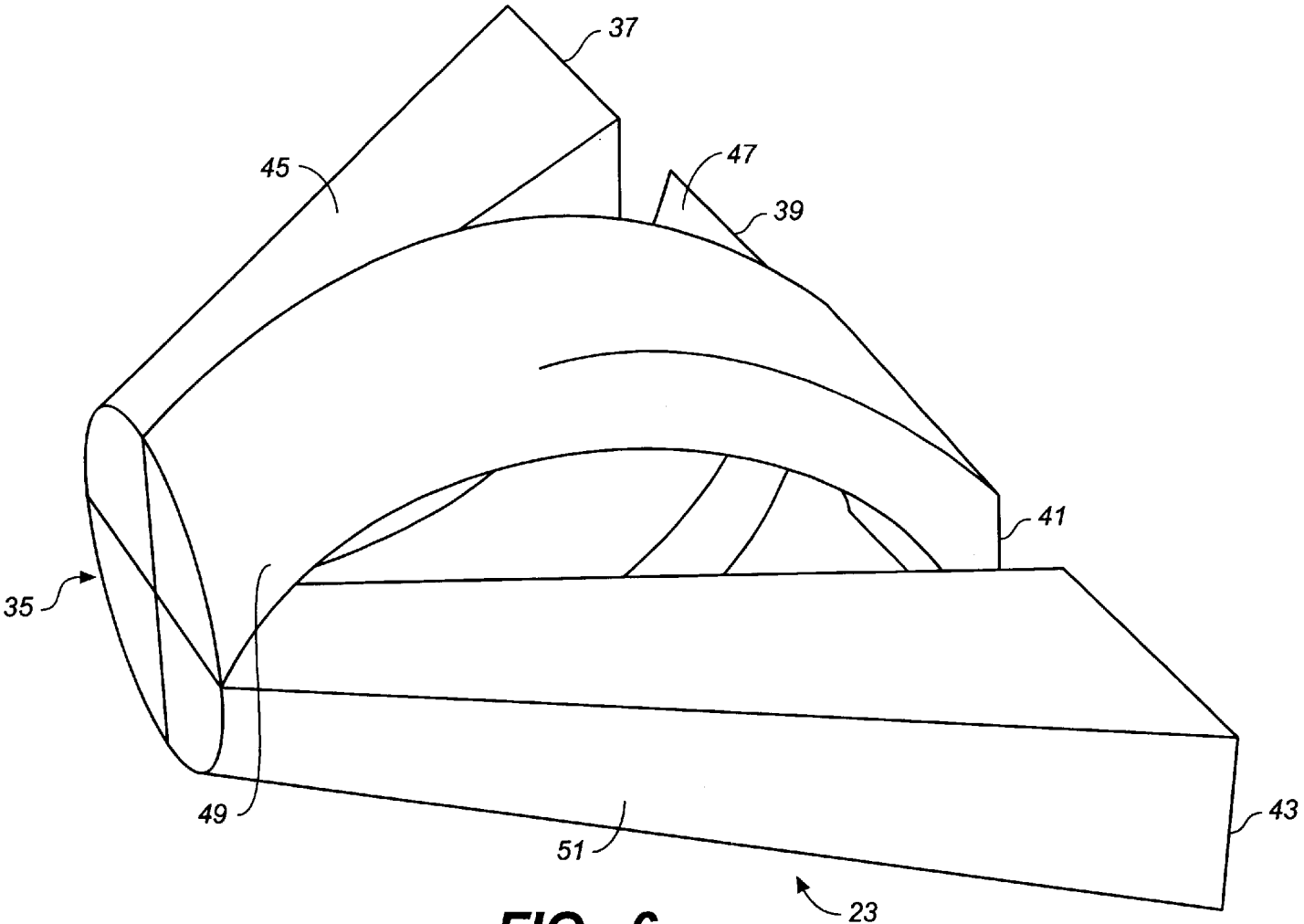
FIG. 6 is a top perspective pictorial representation of a manifold in accordance with the invention for use with one acoustic driver.

The design of the horn of the horn loudspeaker system shown in FIGS. 1–3 is further illustrated in FIGS. 4–5. Referring to these figures, it can be seen that the horn's substantially square mouth 15 has a perimeter mounting flange 16 for mounting the horn to a speaker cabinet. As best shown in FIG. 5, flared vertical sidewalls 25 extend inwardly to form an elongated throat opening 27 which extends between slightly flared top and bottom sidewalls 29. As hereinafter described, this elongated opening allows a virtual line array of acoustic sources to be created at the throat of the horn from the two compression drivers 17 which are mounted to a mounting flange 31 at the back end of the horn.

A simple single driver manifold in accordance with the invention is pictorially illustrated FIGS. 6–9. Referring to these figures, manifold 33 is shown as having an input port 35 and four aligned output ports 37, 39, 41, 43 connected to the single input port by four acoustic power waveguides 45, 47, 49, 51. The waveguides are arranged in the manifold such that their acoustical path lengths between input port 35 and output ports 37, 39, 41, 43 are approximately equal. To provide for approximately equal acoustical path lengths between the input port and the four aligned output ports, the two outer waveguides 45, 51 are straight and angled while the two inner waveguides 47, 49 are curved. The curved inner waveguides 47, 49 are seen to terminate at the two inner output ports 39, 41 so as to place these output ports in alignment with the outer ports 37, 43 associated with the two straight outer waveguides.

Figure 7:
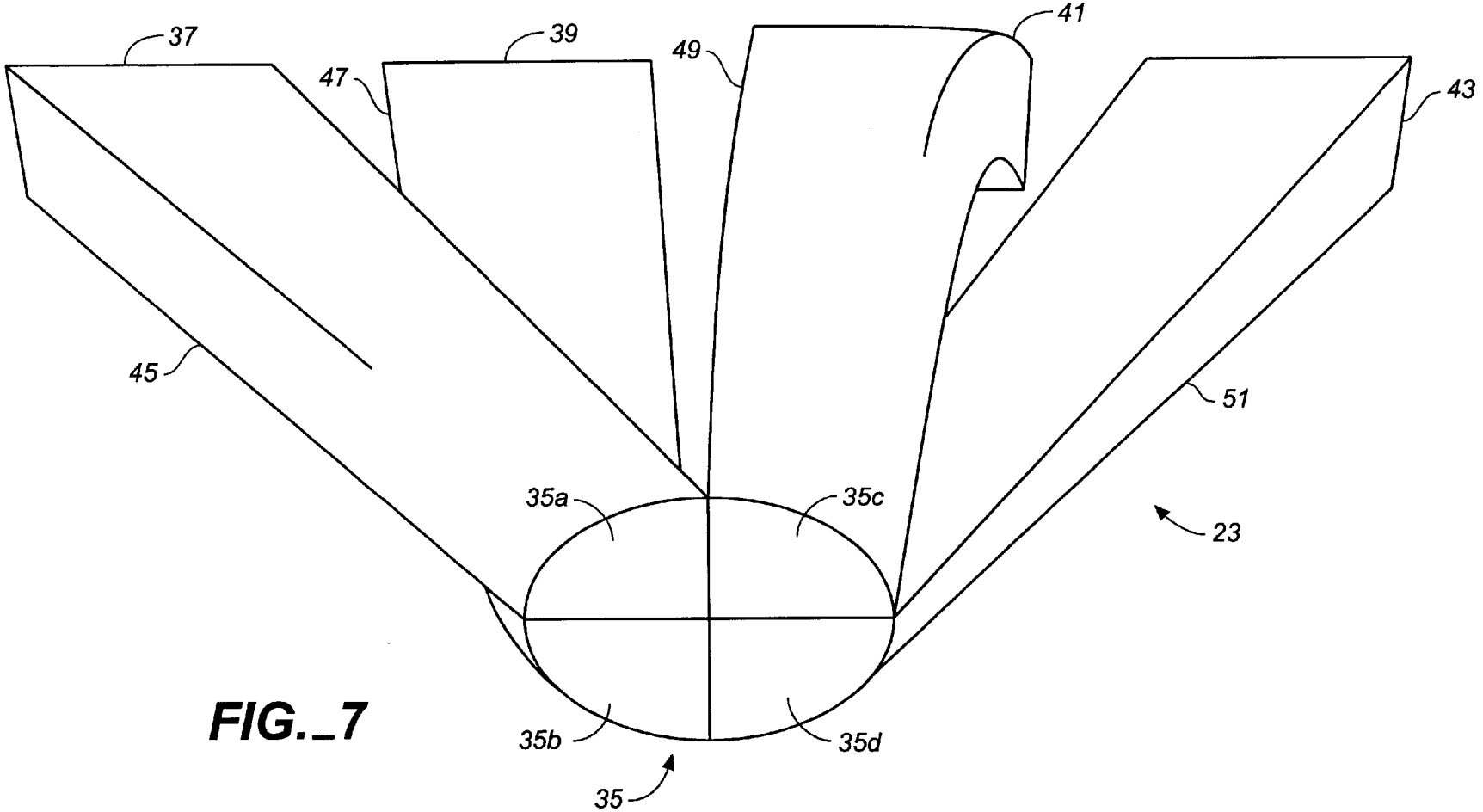
FIG. 7 is another top perspective view thereof.
Figure 8:
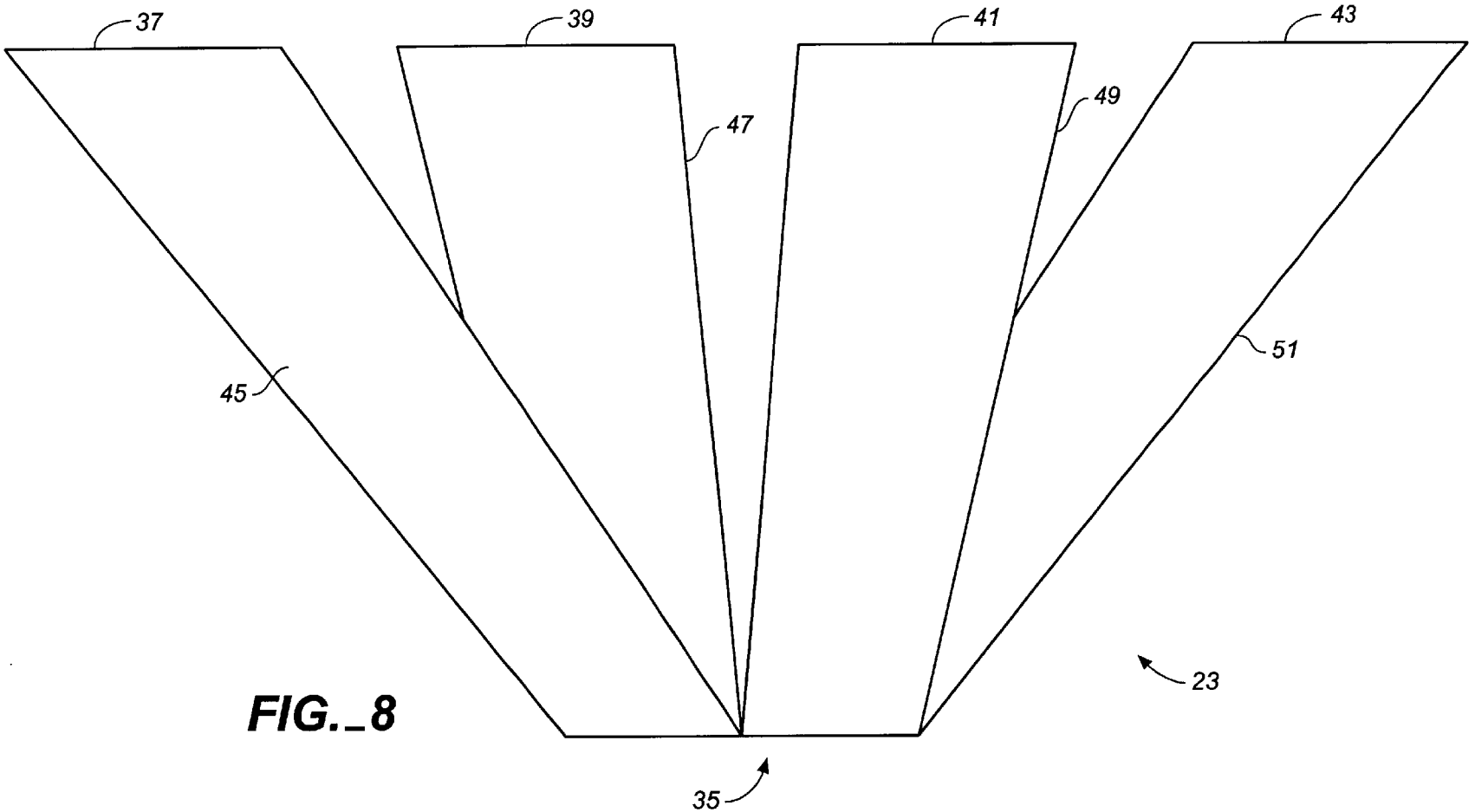
FIG. 8 is a top plan view thereof.
Figure 9:
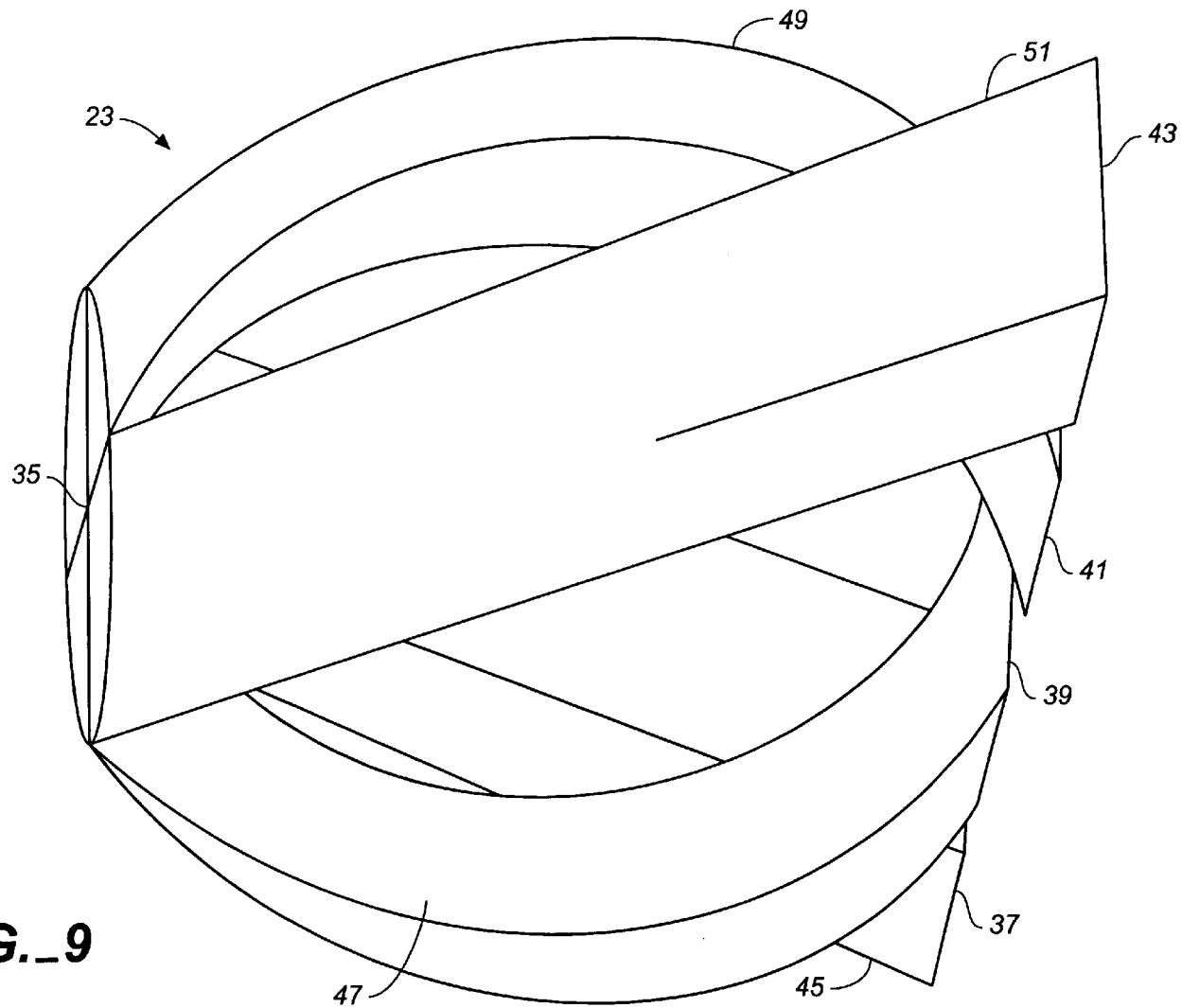
FIG. 9 is an end perspective view thereof.

Referring to FIG. 7, it can be seen that the input port 35 is partitioned into four quarter circles 35*a*, 35*b*, 35*c*, 35*d* which form the start or first ends of the four manifold waveguides 45, 47, 49, 51. It is also seen that the four waveguides of the manifold transition from these quarter circular shapes to a rectangular shape at the second terminal end of the waveguides, that is, the ends that form the aligned output ports. As also shown and as further described below, the cross-sectional area of each waveguide expands from a relatively small cross-sectional area at the input port 35 to a larger cross-section at the output port as acoustic waves progress through the waveguide. It has been found that such cross-sectional area expansion will act to reduce distortion as the sound pressure waves pass through the manifold. A manifold might, for example, be provided with a circular input port measuring 1½ inches in diameter to couple to a compression driver having a four inch inverted dome. The circular input port bifurcates into clusters of four initially quarter-circle waveguide ends having a cross-sectional area of about 0.44 square inches. Each of the waveguides can suitably be allowed to expand to form a rectangular output port about ¾ inch wide and 1¼ inches long having a cross-sectional area of about 0.93 square inches. With such a transition and expansion, the cross-sectional area of each of the waveguides roughly doubles between the input or output ends of the manifold.

Preferably, the length of the manifold from its input port 35 to its aligned output ports 37, 39, 41, 43 is kept as short as possible such that sound waves are retained in the manifold for as short a period of time as possible. Physically, it is desirable to keep the length of the manifold no longer than approximately three wavelengths at the highest operating range of the horn loudspeaker system. For a horn loudspeaker having a high end operating range of 15,000 cycles, a manifold length of approximately 3 inches would be suitable.

Figure 10:
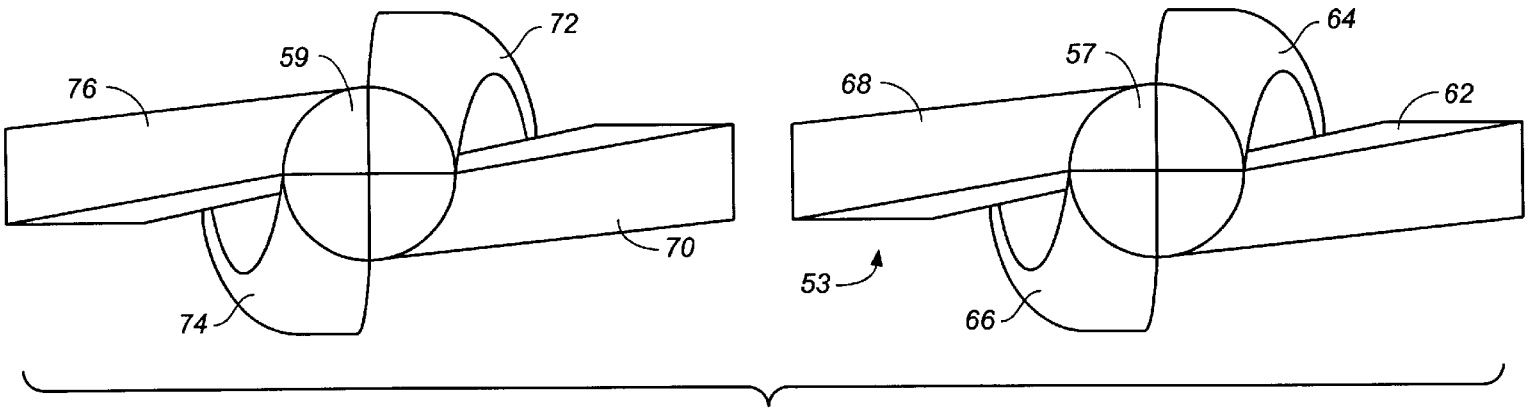
FIG. 10 is a front elevational pictorial view of a manifold in accordance with the invention for two side-by-side acoustic drivers as shown in FIG. 1.
Figure 11:
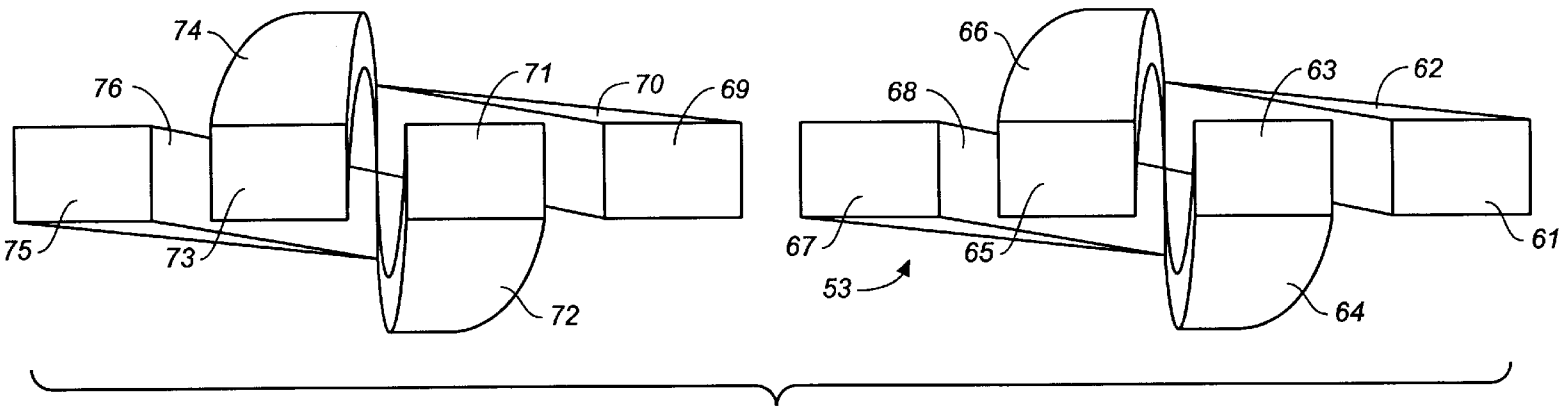
FIG. 11 is a rear elevational view thereof showing eight aligned output ports of the manifold.

FIGS. 10–11 pictorially illustrate a manifold for use with two side-by-side drivers as shown in FIGS. 1–3. It is understood that this manifold could be fabricated as a single manifold or as two separate side-by-side manifold sections.

Specifically, manifold 53 has two side-by-side input ports 57, 59 for receiving acoustic power from two compression drivers, and four aligned output ports 61, 63, 65, 67 and 69, 71, 73, 75 associated with each input port for a total of eight aligned output ports. The aligned array of output ports are positioned in front of the elongated throat opening 27 of the loudspeaker system's horn 13 to produce a line array of eight virtual acoustic power sources along the throat opening. Each output port has an associated straight or curved acoustic power waveguide connecting the output port with its associated input port. Thus, output ports 61, 63, 65, 67 are seen to be connected to input port 57 by straight outer waveguides 62, 68 and curved inner waveguides 64, 66, while output ports 69, 71, 73, 75 are connected to input port 59 by straight outer waveguides 70, 76 and curved inner waveguides 72, 74. As with the single driver embodiment of FIGS. 6–9, the acoustical path lengths of all eight waveguides of the two driver embodiment are preferably approximately equal, such that the power delivered by the two compression drivers 17 arrive at the eight aligned output ports approximately in phase.

Figure 12:
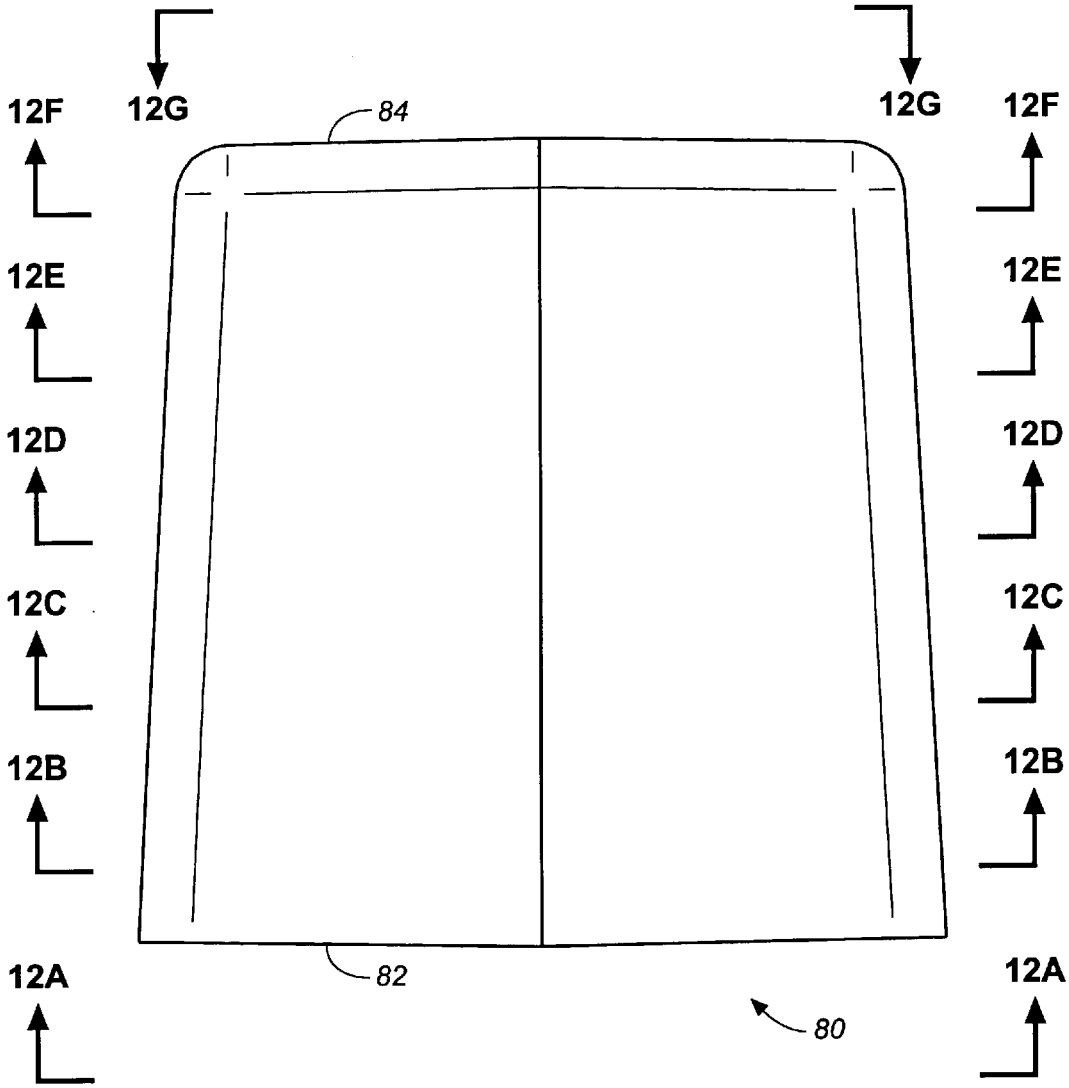
FIG. 12 is a end elevational view of a manifold block having two input ports and eight output ports as in the manifold pictorially illustrated in FIGS. 10–11, and showing how the block is sectioned in FIGS. 12B–12F to reveal the relative shapes and positions of the manifold waveguides as the manifold waveguides progress from the two input ports to the eight output ports of the manifold.
Figures 12A, 12B, 12C, 12D, 12E, 12F, 12G:
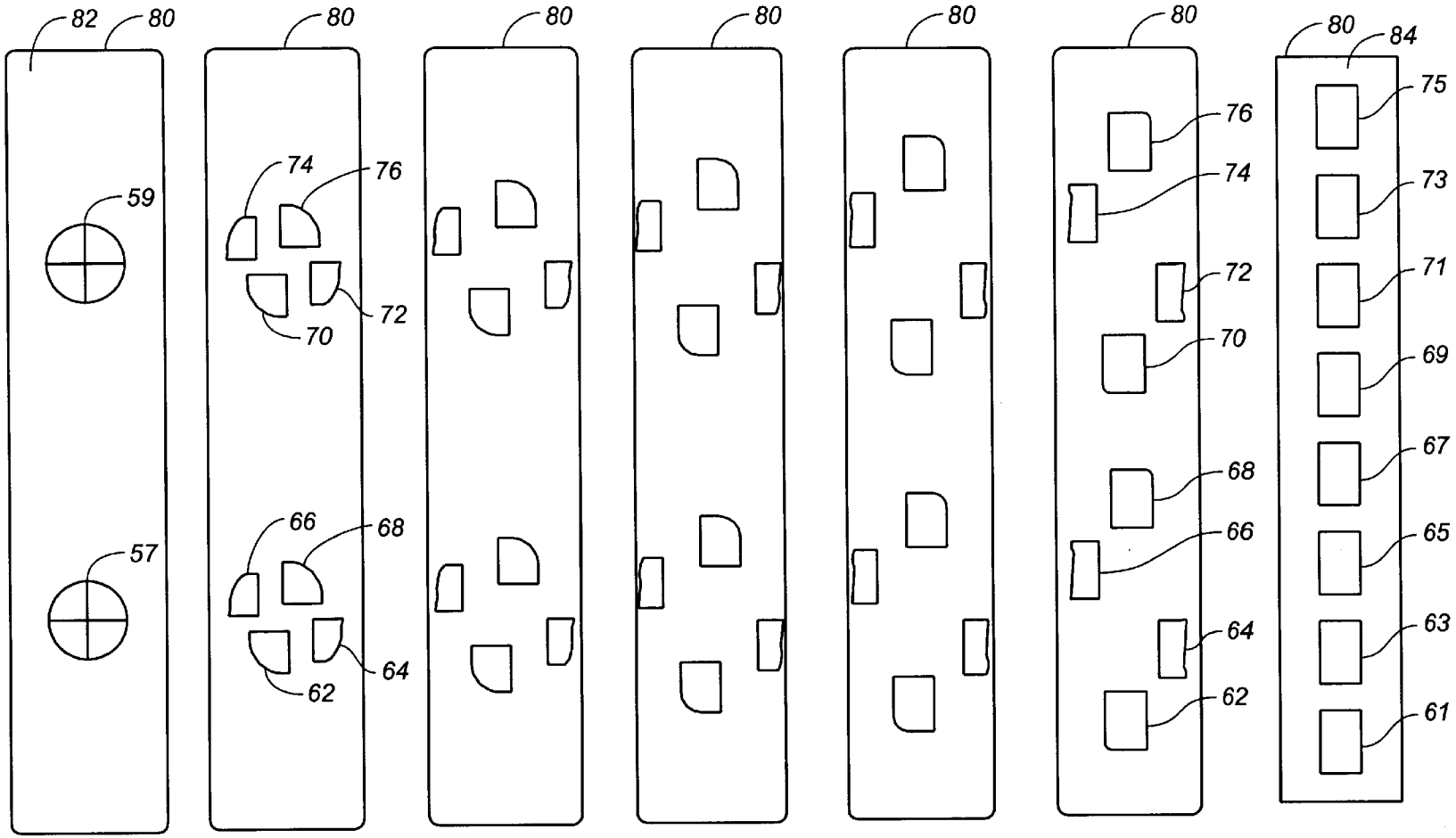
FIG. 12A is a front elevational view thereof as seen from lines 12A—12A of FIG. 12.
FIG. 12B is a cross-sectional view thereof taken along lines 12B—12B of FIG. 12.
FIG. 12C is a cross-sectional view thereof taken along lines 12C—12C of FIG. 12.
FIG. 12D is a cross-sectional view thereof taken along lines 12D—12D of FIG. 12.
FIG. 12E is a cross-sectional view thereof taken along lines 12E—12E of FIG. 12.
FIG. 12F is a cross-sectional view thereof taken along lines 12F—12F of FIG. 12.
FIG. 12G is a rear elevational view thereof as seen from lines 12G—12G of FIG. 12.
Figure 13:
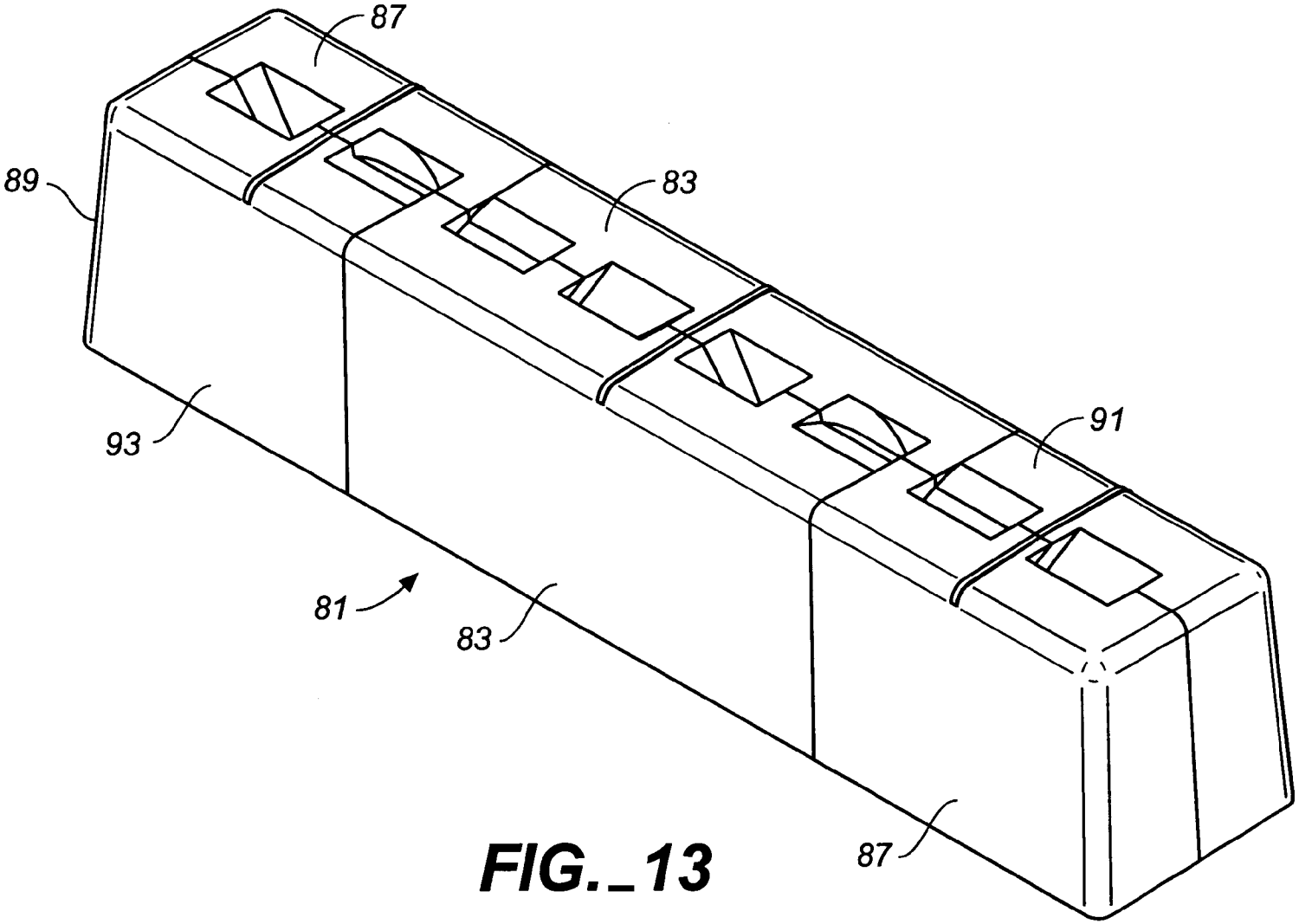
FIG. 13 is a top perspective view of a manifold in accordance with the invention comprised of assembled molded manifold blocks, and illustrates a technique for fabricating a manifold with manifold waveguides or the sort pictorially illustrated in FIGS. 6–11.
Figure 14:
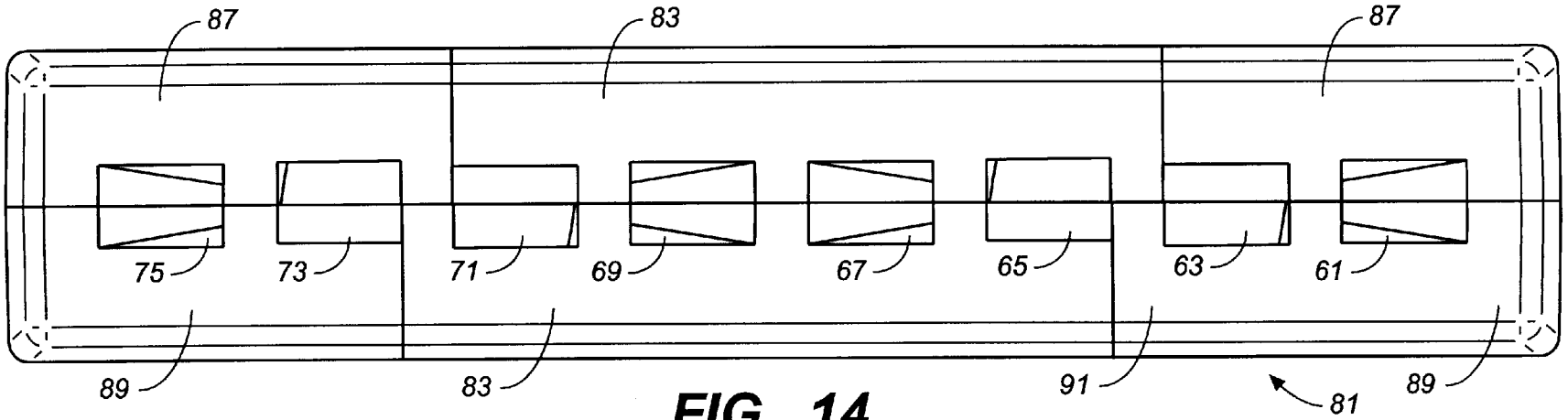
FIG. 14 is a front elevational view thereof.

FIGS. 12 and 12A–12G show a two driver, eight output port manifold as depicted in FIGS. 10 and 11 fabricated as a manifold block 80 having an input end 82 and output end 84. These figures also show how the two sets of waveguides of the manifold transition from clustered quarter circles at the two manifold input ports to a line array of eight rectangular output ports. FIG. 12A shows the quarter partitioned input ports 57, 59 at the input end of the manifold block. Proceeding from the input end 82 toward the output end 84 of the manifold block as shown in FIGS. 12B–12F, the waveguides 62, 64, 66, 68, and 70, 72, 74, 76 formed in the block diverge from a cluster of guides into an aligned orientation; they also expand from a quarter round shape to an almost rectangular shape of a larger cross-sectional area. At the block's output end 84 the waveguides emerge as eight fully aligned and fully rectangular output ports 61, 63, 65, 67, 69, 71, 73, and 75 as shown in FIG. 12G. This block is inserted into the manifold mounting chamber 21 at the back end of the horn 13 shown in FIGS. 1–5, with the output end 84 and its eight aligned output ports facing the elongated throating opening of the horn.

With line array of eight rectangular output ports shown in FIGS. 10–12, and with rectangular openings having a 1¼ inch long dimension aligned in the direction of the elongated throat opening, a suitable separation for the output ports is approximately 1¾ inches center-to-center. With such a separation, dispersion in the direction of the elongated throat opening of the horn can be tightly controlled at most frequencies within the operating frequency range of the horn, with a dispersion of 10 degrees or better being achievable at high frequencies. Such tightly controlled dispersion characteristics can be extended into lower frequency ranges by increasing the length of the line array at the throat end of the horn, however, physical limitations will dictate trade-offs in these regions.

FIGS. 13–19 illustrate a means for constructing a driver manifold of the invention from molded parts, suitably using an ABS plastic material. FIGS. 13–16 show a manifold block assembly 81 comprised of two identical center blocks 83 and two pairs of end blocks 87, 89. As hereinafter described, these blocks, when assembled, form the waveguides of the two driver manifold 53 illustrated in FIGS. 10 and 11. When assembled, eight aligned rectangular output ports 61, 63, 65, 67, 69, 71, 73, 75, appear along assembled block's rear face 91. This forms the output end of the manifold. When assembled, the block assembly further creates two input ports 57, 59 on its front face 93 which constitutes the manifold's input end (see FIG. 15).

Figure 17:
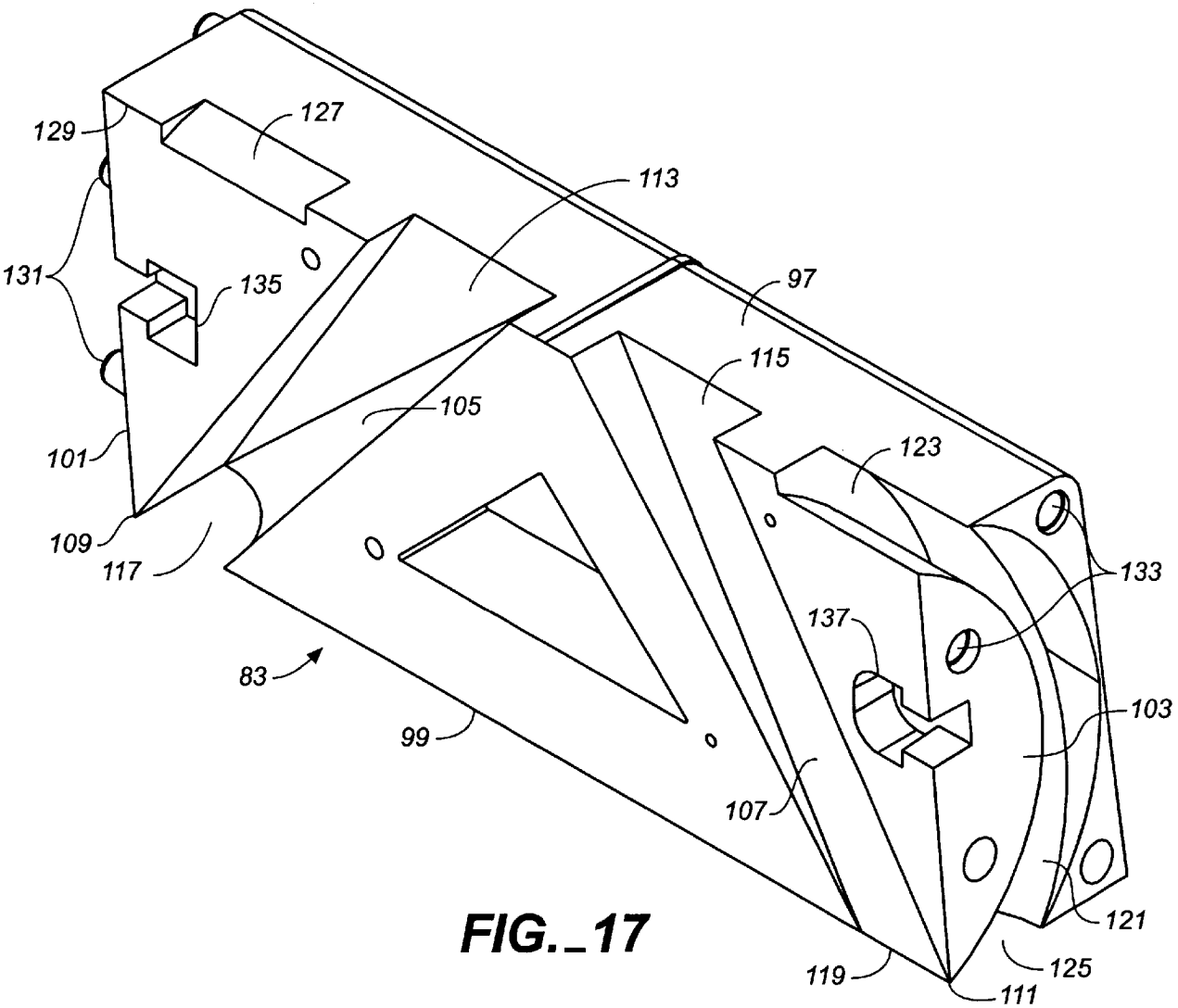
FIG. 17 is a top perspective view of one of the center blocks of the manifold block assembly shown in FIGS. 13–16.
Figure 18:
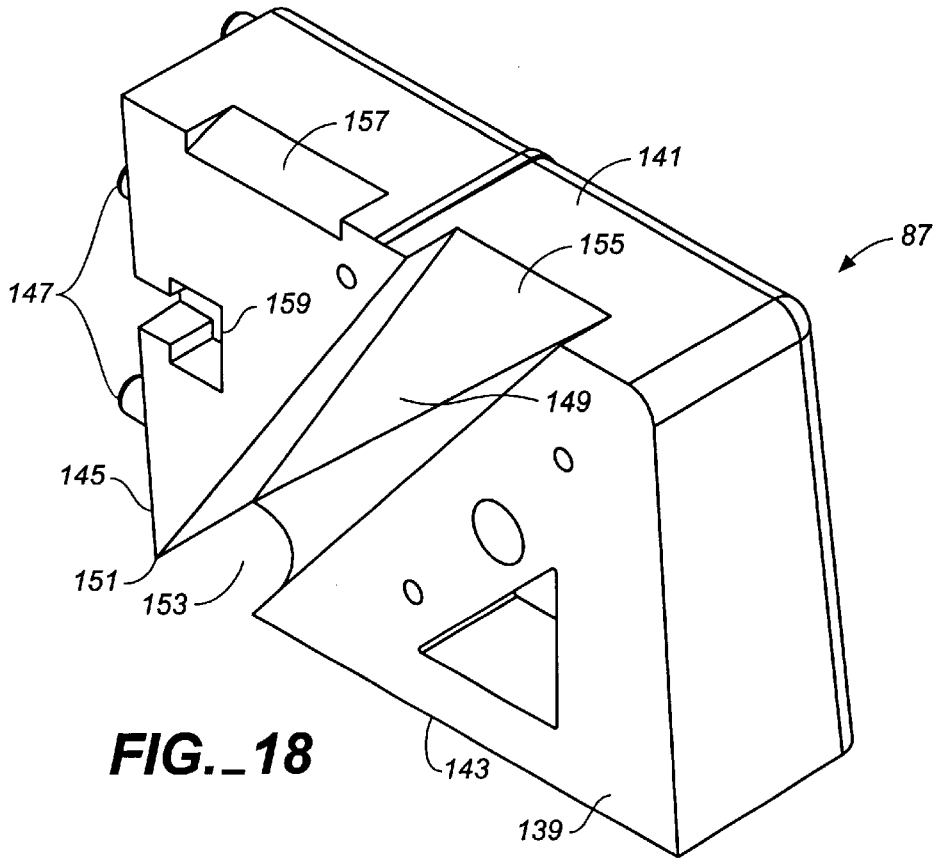
FIG. 18 is a top perspective view of one of the end blocks of the manifold block assembly shown in FIGS. 13–16.
Figure 19:
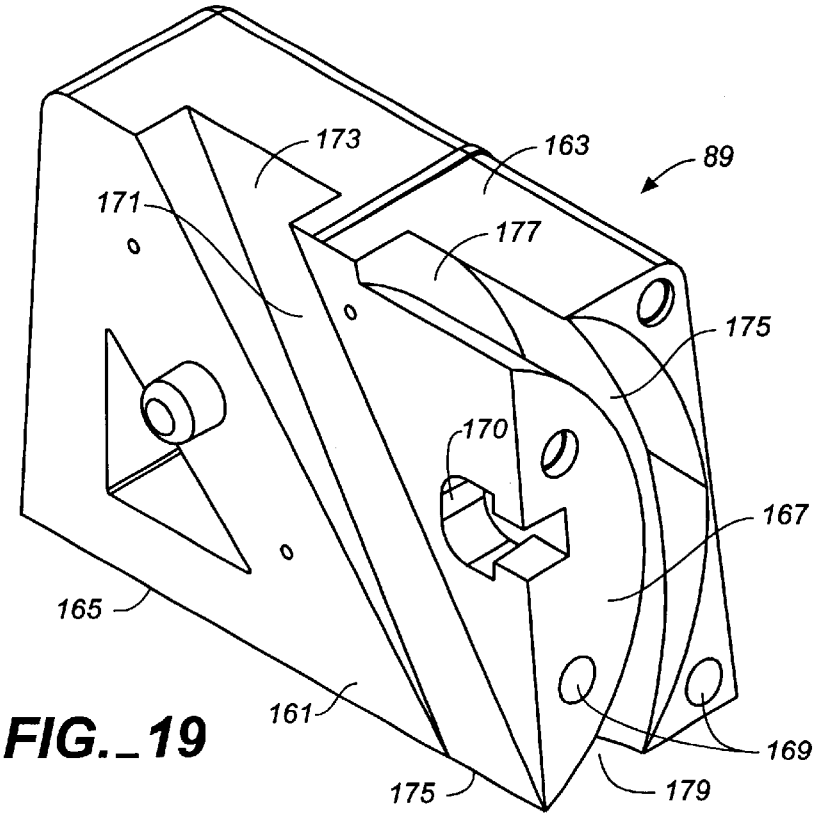
FIG. 19 is a top perspective view of another one of the end blocks of the manifold block assembly shown in FIGS. 13–16.
Figure 20:
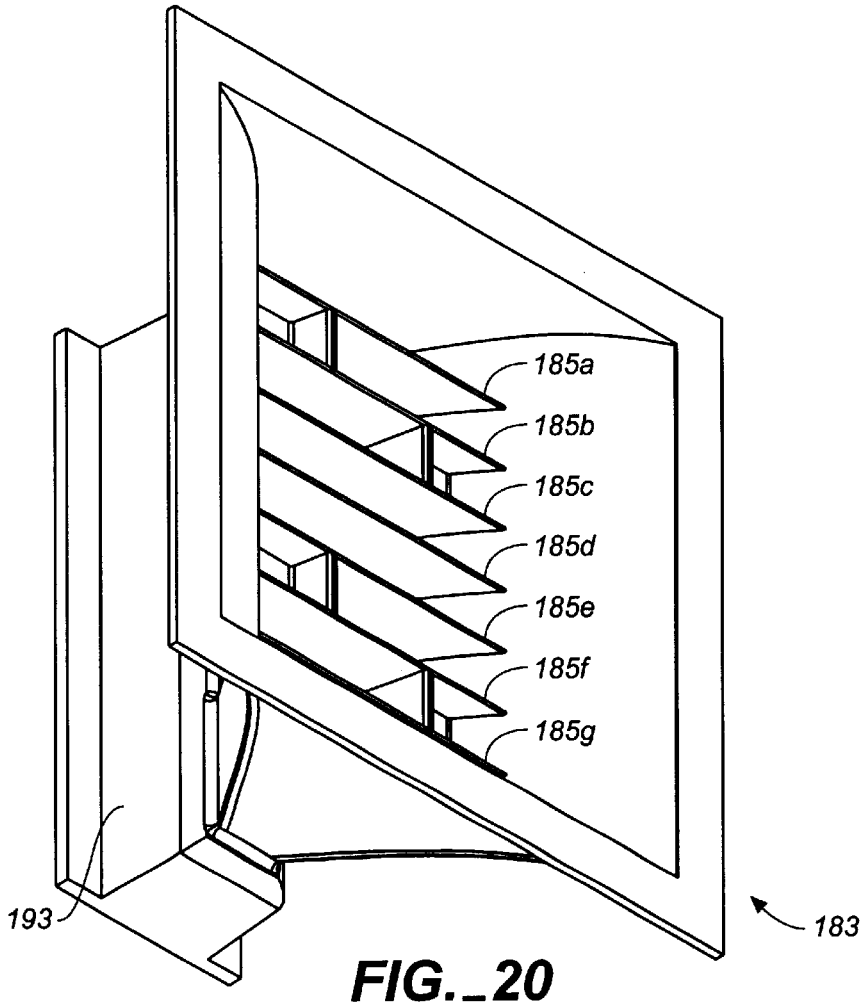
FIG. 20 illustrates a modified version of the loudspeaker horn shown in FIGS. 1–5, used to gain greater control over the dispersion characteristics of a horn loudspeaker using a manifold in accordance with the invention.
Figure 23:
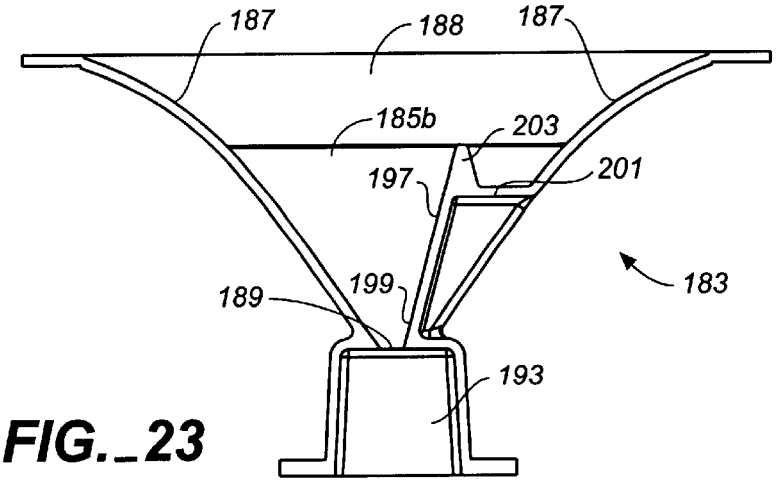
FIG. 23 is a cross-sectional view thereof taken along lines 23—23 of FIG. 22.
Figure 21:
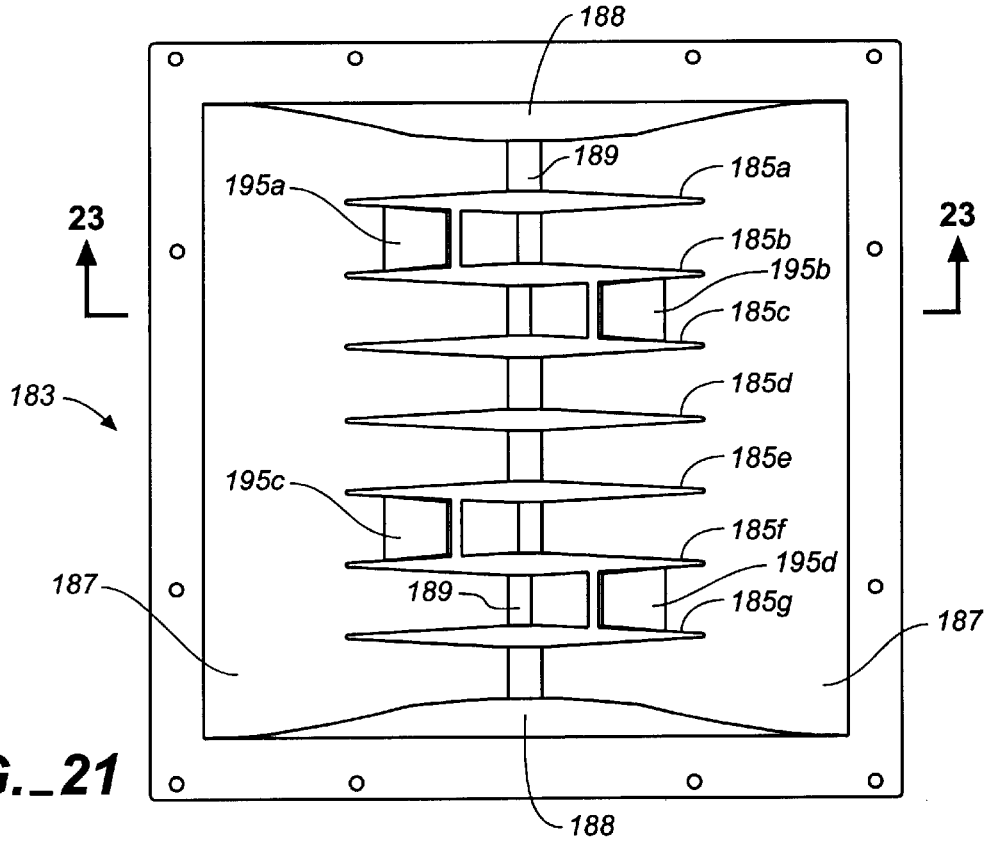
FIG. 21 is a front elevational view thereof.

FIGS. 17–19 illustrate the individual blocks of the manifold block assembly 81. In describing these blocks, and their assembly, it again noted that the output ports and waveguides of the manifold can be divided into two sets of output ports and waveguides corresponding to the manifold's two input ports. More specifically, the manifold block assembly has a first set of output ports 61, 63, 65, 67, which include outer ports 61, 67 and inner ports 63, 65. A corresponding first set of acoustic power waveguides 62, 64, 66, 68 include substantially straight outer waveguides 62, 68 and curved inner waveguides 64, 66. Similarly, a second set of output ports 69, 71, 73, 75 include outer output ports 69, 75 and inner output ports 71, 73. A second set of corresponding acoustic power waveguides 70, 72, 74, 76 include outer substantially straight waveguides 70, 76 and two curved inner waveguides 72, 74.

Referring to FIG. 17, each of the two center blocks 83 are seen to include an interior face 95, back wall 97 (corresponding to the output end of the manifold), a front wall 99 (corresponding to the input end of the manifold), and slightly angled end walls 101, 103. Straight channels 105, 107, which are formed in the interior face 95 of the block, angle inwardly from the block's front wall 99 at corners 109, 111 to the block's back wall 97. The channels terminate near the center of the back wall to provide half rectangular openings 113, 117 which form one-half of two of the outer output ports of the manifold. Specifically, the half opening 113 of channel 105 forms one-half of the outer output port 67, whereas the half opening 115 of channel 107 forms one-half of the outer output port 69.

It is seen that each of the channels 105, 107 have different transitional shapes. Channel 105 transitions from the half rectangular opening 113 down to a quarter circle opening 117 at the far corner 109 of front wall 99. Conversely, channel 107 transitions from a half rectangular opening 115 down to a straight edge 119 at the near corner 111 of the front wall. When the interior faces 95 of the two center blocks 83 are placed together as shown in the exploded view of FIG. 16, channel 105 of one center block will oppose channel 107 of the other center block to form two of the straight waveguides of the manifold.

It is further seen that the near end wall 103 of each of the center blocks 83 includes a curved channel 121 for providing one of the curved waveguides of the manifold. Curved channel 121 terminates at the block's back wall 97 in a partial rectangular opening 123; at the other end it terminates at the block's front wall 99 to produce opening 125. The partial opening 123 forms a portion of one of the inner output ports of one of the two sets of output ports, whereas opening 125 is a quarter circle which forms one quadrant of one of the manifold's circular input ports.

Figure 15:
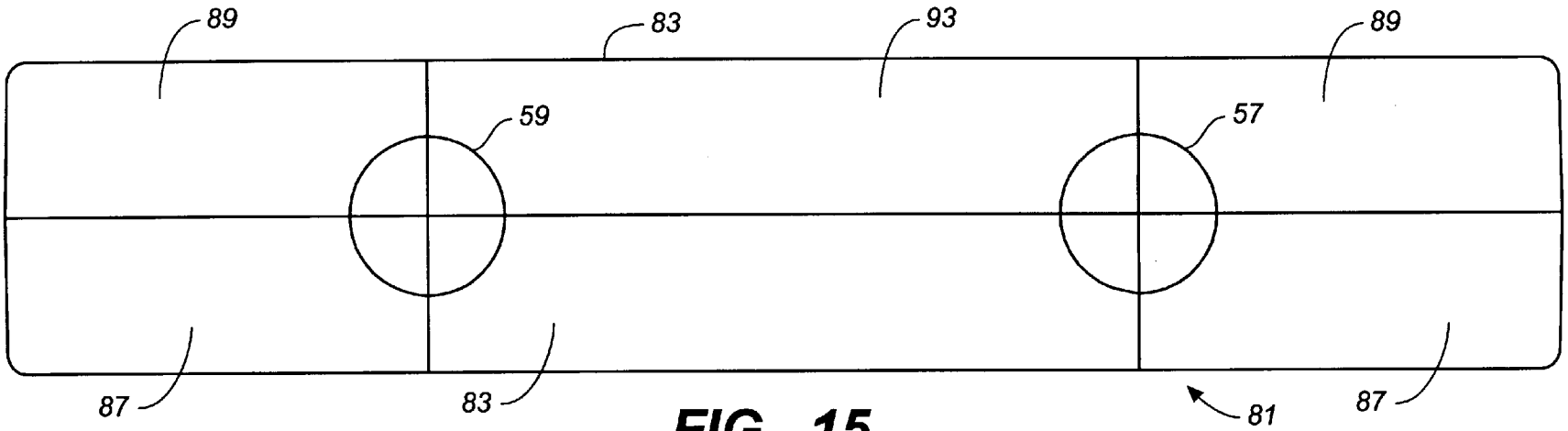
FIG. 15 is a rear elevational view thereof.

The back wall of each center block additionally includes an angled notch 127 along the block's interior edge 129 at the end of the block opposite curved channel 121. When the two center blocks are assembled face-to-face, this notch will provide a completion of the rectangular opening 123 to form one of the inner rectangular output ports of the block assembly. When assembled, the two center blocks of the manifold block assembly will thus provide one outer and one inner output port for each set of output ports of the manifold (a total of four output ports), as well as their corresponding straight and curved waveguides. As best shown in FIG. 15, the two center blocks, when assembled, also provide one-half of each of the input ports of the manifold.

The center blocks are seen to additionally include dowel pins 131 and dowel holes 133 on the end walls of the blocks to permit the attachment of end blocks 87, 89 to the center blocks in a proper alignment. Key slots 135, 137 are additionally provided at the ends of the center blocks to allow the center blocks and end blocks to be locked together with a locking key member (not shown).

Referring to FIG. 18, the two end blocks 87 of the manifold block assembly include interior face 139, back wall 141, front wall 143, and an end wall 145 which is slightly inclined to match the angle of end walls of the center blocks. As with the center blocks, the back wall of these end blocks correspond to the output end of the manifold whereas the front wall 143 corresponds with the input end. Dowel pins 147 are provided in the end wall 145 which insert into the dowel holes of the center blocks.

The end blocks 87 are seen to include a single substantially straight channel 149 formed in the blocks interior face 139. This channel extends at an angle through the block from the block's front wall 143 at upper corner 151 to the block's back wall 141. This straight channel also transitions from a corner circle opening 153 at the block's front wall, to a one-half rectangular opening 155 at the block's back wall. Opening 155 provides one-half of one of the outer rectangular output ports of the manifold, while opening 153 provides one-quarter of one of the manifold's input ports. The back wall 141 of each end block 87 still further includes an angled notch 157 for providing a portion of one of the inner output ports when the center block is matched with one of the end blocks 89 described below. Key slot 159 in the end block provides a link to key slot 137 in the center block for locking the blocks together with a key lock member.

FIG. 19 shows one of the end blocks 89 which, in the assembled manifold block, faces one of the end blocks 87. End block 89 includes interior face 161, back wall 163, front wall 165, and an inclined end wall 167 with dowel holes 169. It also includes a key slot 170 for key locking these end blocks to the center blocks. An angled straight channel 171 formed in the interior face 161 of the block terminates at the back wall 163 in a one-half rectangular opening 173 and at the front wall 165 at an edge 175. When an end block 87 is placed together with one of the end blocks 89, the straight channels 149, 171 in the two end blocks will form one of the straight outer waveguides of the manifold assembly in a manner similar to the above-described way the two straight waveguides are formed by the two center blocks. When the end blocks are placed together, the one-half rectangular openings 155, 173 formed by these channels similarly form one of the outer output ports of the manifold (either output port 61 or output port 75).

The end block 89 shown in FIG. 19 also includes a curved channel 176 which terminates at the back wall 163 in a partial rectangular opening 177 and at the front wall 165 in a quarter-circle opening 179. Similar to the curved channel 121 of center blocks 83, the curved channel 176 in end block 89 provides one of the curved inner waveguides of the manifold. Also, when blocks 87 and 89 are assembled, the partial rectangular opening 177 in block 89 and the notch 157 of block 87 will meet to form one of the inner output ports of the manifold's aligned array of output ports (either output port 63 or output port 73). Similarly, the curved opening 179 will form one-quarter of one of the input ports of the manifold.

Figure 16:
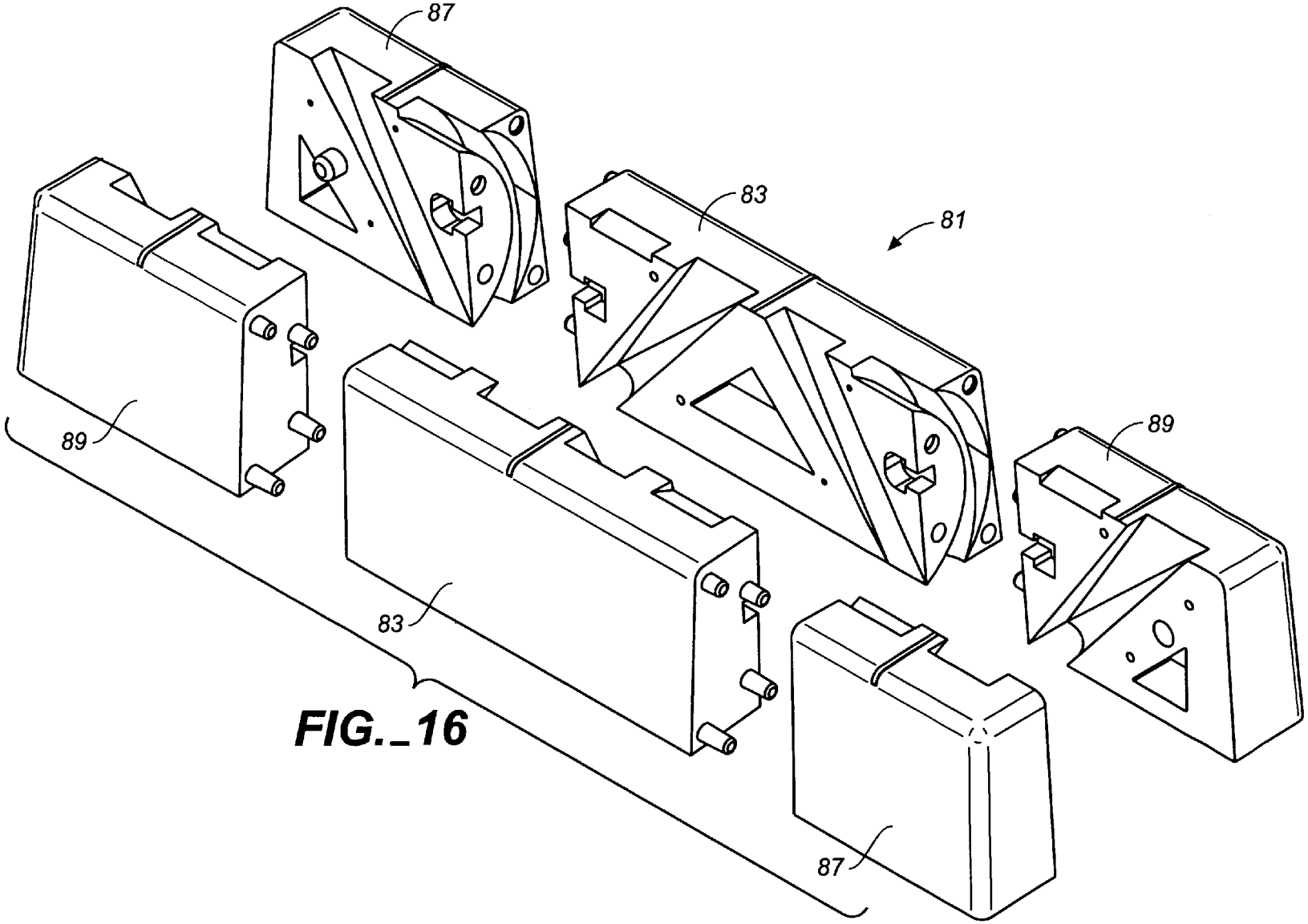
FIG. 16 is an exploded view of the manifold block assembly shown in FIG. 13.

Thus, it can be seen that the assembly of the center blocks 83 with the end blocks 87, 89 of the manifold as illustrated in FIG. 16 will provide a manifold block assembly having two input ports and two sets of four output ports connected to the input ports by straight and curved waveguides. By providing curved waveguide paths, the acoustical path length of inner waveguides of the two sets of waveguides can be made approximately equal to the acoustical path length of the outer straight waveguides. Also, the waveguides can be constructed such that the first end of the waveguide, that is, the end at one of the input ports of the manifold, has the shape of a quarter-circle, and such that the first ends of the four waveguides associated with the input port meet in a cluster to form a completely circular input port. The waveguides can also be made to transition from quarter-circles at the input port to rectangular shapes at the manifold's output ports. This transition occurs while the cross-sectional area of the waveguide progressively increases through the manifold.

FIGS. 20–23 illustrate an alternative embodiment of a loudspeaker horn which can be used to gain greater control over the dispersion characteristics of a horn loudspeaker using a manifold in accordance with the invention. In FIGS. 20–23, the horn 183 is similar to the horn illustrated in FIGS. 1–5, except that the horn includes the addition of a series of fins 185*a*–185*g* which extend between the horn's flared side walls 187, and from the horn's elongated throat opening 189 toward its mouth opening 191. The fins are distributed along the elongated throat opening such that they will be positioned between the output ports of a manifold placed in the manifold mounting chamber 193 at the back end of the horn.

Figure 22:
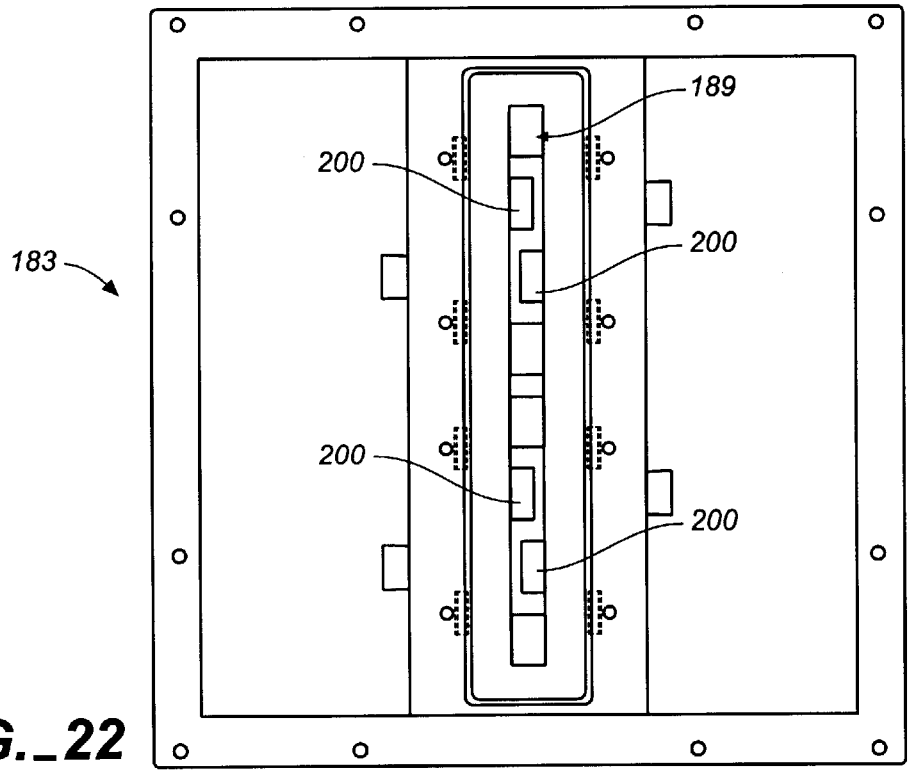
FIG. 22 is a rear elevational view thereof.

Specifically, this horn design is shown as having seven fins which would correspond to a two driver manifold such as illustrated in FIGS. 10–11 having eight rectangular output ports arranged in two sets of four output ports corresponding to two input ports. Referring to FIGS. 10 and 11, the first set of output ports 61, 63, 65, 67 correspond to input port 57, and the second set of output ports 69, 71, 73, 75 correspond with input port 59. Of these two sets of output ports, the outer ports of each set, namely ports 61, 67 and 69, 75, are associated with the straight waveguides of the manifold, namely, waveguides 62, 68 and 70, 76, whereas the inner output ports of each set, namely ports 63, 65 and 71, 73, are associated with the inner curved waveguides of the manifold, namely, waveguides 64, 66 and 72, 74. Inset blocks 195*a*–195*d* are inserted between the fins governing the inner output ports 63, 65 and 71, 73 associated with the curved waveguide paths. Each of these inset blocks include a steeply angled wall 197 having a base end 199 which has the effect of decreasing the area of the horn's throat at inner rectangular output ports, as shown in FIG. 22 by the restricted openings 200 in elongated throat 189.

The fins of this horn design provide two primary functions. The first is to vertically straighten the higher frequency sound delivered by the center-most output ports of the manifold's eight output ports, namely, output ports 67, 69. The other is to provide isolation between the output ports of the manifold so that the effects of the curved acoustical paths on the sound passing through the manifold can be corrected for on an individual basis. The effects of the curved acoustical paths are corrected by the blocks placed between those fins which surround the output ports associated with the curved paths, namely, between fins 185*a* and 185*b*, 185*b* and 185*c*, 185*e* and 185*f*, and 185*f* and 185*g*.

More specifically, the inset blocks are used to counteract the tendency of curved acoustical paths to steer the higher frequencies. To keep the coverage of the horn loudspeaker relatively even and distributed properly at high frequencies, inset blocks 195*a*–195*d* cause the walls of the horn to effectively be brought into the horn's throat at a steeper angle adjacent those output ports of the manifold associated with curved waveguide paths. Also, by effectively restricting the horizontal width of these output ports, the ports receiving acoustic power through the curved waveguide paths will tend to disburse the high frequency sound emanating from the curved acoustic paths more evenly.

Also, it is noted that the angled wall 197 of the inset blocks projects up pass the block's cross wall support 201 to create a projecting tower structure 203. It is found that such a tower structure creates more favorable boundary conditions at the top of the inset block for producing more even and properly distributed coverage of the sound.

The horn shown in FIGS. 20–23 is illustrative of horn modifications that can be made to achieve desired dispersion characteristics of a horn loudspeaker using the manifold of the invention over a desired frequency range. Specific designs to achieve specific dispersion characteristics are achieved through trial and error. It is understood that the variety of horn designs and modifications could be implemented with the manifold of the invention to achieve desired results.

Therefore, it can be seen that the present invention provides for a manifold for a horn loudspeaker that can be used in conjunction with a horn having an elongated throat opening and that can be used to simulate a line array of acoustic power sources at the throat end of the horn to permit greater control over the dispersion characteristics of the loudspeaker. While the invention has been described in considerable detail in the foregoing specification, it shall be understood that it is not intended that the invention be limited to such detail, except as necessitated by the following claims.

What we claim is:

1. A manifold for delivering acoustic power to the throat end of a horn of a horn loudspeaker, said manifold comprising an input end having at least one input port for receiving acoustic power from at least one acoustic driver, an output end for delivering acoustic power to the throat end of the horn, said output end having at least two aligned output ports, and an acoustic power waveguide associated with each of the aligned output ports and connecting said output ports to said at least one input port, such that acoustic power received by said input port is divided between said acoustic waveguides, and such that the acoustic power divided between said acoustic power waveguides is delivered to said aligned output ports to simulate a line array of acoustic power sources, the acoustic path lengths of said acoustic power waveguides from said at least one input port to said aligned output ports being relatively short in relation to the wavelength of the acoustic power passing through the manifold at the highest operating frequency range of the horn loudspeaker.

2. The manifold of claim 1 wherein the acoustic path lengths of said acoustic power waveguides from said at least one input port to said aligned output ports are approximately equal such that acoustic power divided at said at least one input port arrives at the aligned output ports approximately in phase.

3. The manifold of claim 1 wherein the length of the manifold from the input end to the output end is less than three wavelengths at the highest operating frequency range of the horn loudspeaker for which the manifold is used.

4. The manifold of claim 1 wherein the length of the manifold from the input end to the output end is less than approximately 3 inches.

5. The manifold of claim 1 wherein the length of the manifold from the input end to the output end is approximately 3 inches.

6. The manifold of claim 1 wherein each of said acoustic power waveguides have a defined cross-sectional area and wherein said cross-sectional area increases from said input port to the output port associated with each said waveguide.

7. The manifold of claim 6 wherein the cross-sectional area of each said acoustic power waveguides approximately doubles from said input port to the output port associated with each said waveguide.

8. The manifold of claim 1 wherein said output end includes four aligned output ports, wherein four acoustic power waveguides connect said four aligned output ports to said at least one input port, and wherein the four acoustic waveguides connected said output ports to said input port such that the acoustic power received by said input port is divided approximately equally between said four waveguides.

9. The manifold of claim 8 wherein said input port is circular and wherein said acoustic power waveguides meet at said circular input port and have quarter circle cross-sectional shapes for receiving approximately one quarter of the acoustic power delivered to said input port.

10. The manifold of claim 9 wherein each said acoustic power waveguide transitions from a quarter circle cross-sectional shape at said input port to a rectangular cross-sectional shape at the output port associated with the waveguide.

11. The manifold of claim 8 wherein the lengths of the four acoustic power waveguides from said input port to the aligned output ports are approximately equal such that acoustic power divided between said four waveguides at said input port arrives at the aligned output ports approximately in phase.

12. The manifold of claim 11 wherein said four aligned output ports form a line array of output ports having two outer ports and two inner ports, and wherein the acoustic power waveguides include substantially straight outer waveguides connecting the outer ports of said line array of output ports with said input port and two inner waveguides connecting the inner ports of said line array of output ports with said input port, each of said inner waveguides having a curved waveguide path to approximately equalize the length the interior waveguides with the straight outer waveguides.

13. The manifold of claim 12, wherein the length of the manifold from the input end to the output end is less than approximately 3 inches.

14. The manifold of claim 12, wherein the length of the manifold from the input end to the output end is approximately 3 inches.

15. The manifold of claim 1 wherein multiple aligned output ports are provided and said aligned output ports form a line array of ports having two outer ports and at least one inner port between said outer ports, wherein the acoustic power waveguides include substantially straight outer waveguides connecting the outer ports of said line array of output ports with said input port, and wherein the acoustic power waveguides further include inner waveguides connecting the inner ports of said line array of output ports with said input port, said inner waveguide having a curved waveguide path to approximately equalize the length the inner waveguides with the straight outer waveguides.

16. The manifold of claim 1 wherein said input end has at least two input ports for receiving acoustic power from at least two acoustic drivers, wherein said output end has at least four aligned output ports, and wherein an acoustic power waveguide is provided for each of said aligned output ports for connecting each of said output ports to one of said input ports, such that acoustic power received by said input ports is divided between said acoustic waveguides and such that the acoustic power divided between said acoustic power waveguides is delivered to said aligned output ports to simulate a line array of at least four acoustic power sources.

17. The manifold of claim 1 wherein said input end has at least two input ports for receiving acoustic power from at least two acoustic drivers, wherein said output end has at least eight aligned output ports, and wherein an acoustic power waveguide is provided for each of said aligned output ports and connects each of said output ports to one of said input ports, such that acoustic power received by said input ports is divided between said acoustic waveguides and such that the acoustic power divided between said acoustic power waveguides is delivered to said aligned output ports to simulate a line array of at least eight acoustic power sources.

18. A manifold for delivering acoustic power to the throat end of a horn of a horn loudspeaker, said manifold comprising an input end having at least one input port for receiving acoustic power from at least one acoustic driver, an output end for delivering acoustic power to the throat end of the horn, said output end having multiple aligned output ports, and an acoustic power waveguide associated with each of the aligned output ports and connecting said output ports to said at least one input port, such that acoustic power received by said input port is divided between said acoustic waveguides and such that the acoustic power divided between said acoustic power waveguides is delivered to said aligned output ports to simulate a line array of acoustic power sources, the acoustic path lengths of said acoustic power waveguides from said at least one input port to said aligned output ports being relatively short in relation to the wavelength of the acoustic power passing through the manifold at the highest operating frequency range of the horn loudspeaker and being approximately equal such that acoustic power divided at said at least one input port arrives at the aligned output ports approximately in phase, and each of said approximately equal length waveguides having a defined cross-sectional area which increases from said input port to the output port associated with each said waveguide.

19. The manifold of claim 18 wherein the length of the manifold from the input end to the output end is less than approximately 3 inches.

20. The manifold of claim 18 wherein the length of the manifold from the input end to the output end is approximately 3 inches.

21. A manifold for delivering acoustic power to the throat end of a horn of a horn loudspeaker, said manifold comprising an input end having at least one circular input port for receiving acoustic power from at least one acoustic driver, an output end for delivering acoustic power to the throat end of the horn, said output end having multiple aligned rectangular output ports, and acoustic power waveguides for connecting said aligned rectangular output ports to said at least one circular input port, the acoustic path lengths of said acoustic power waveguides from said at least one input port to said aligned output ports being relatively short in relation to the wavelength of the acoustic power passing through the manifold at the highest operating frequency range of the horn loudspeaker, and each of said acoustic power waveguides transitioning from a partially circular first end to a rectangular second end which has a cross-sectional area larger than the cross-sectional area of said first end, the second end of each said acoustic power waveguides forming one of said aligned rectangular output ports and the partially circular first ends of said acoustic power waveguides meeting at the input end of the manifold to form said at least one circular input port and permitting acoustic power received by said circular input port to be divided approximately equally between said acoustic power waveguides, wherein the approximately equally divided acoustic power is delivered through said waveguides to said aligned rectangular output ports to simulate a line array of acoustic power sources which simulates a ribbon driver.

22. The manifold of claim 21, wherein the acoustic path lengths of said acoustic power waveguides from said at least one input port to said aligned output ports are approximately equal such that acoustic power divided at said at least one input port arrives at the aligned output ports approximately in phase.

23. The manifold of claim 21 wherein said output end includes at least four aligned output ports, wherein four acoustic power waveguides connect said input port to said four aligned output ports, and wherein the partially circular first ends of said acoustic power waveguides are quarter circles at the input end of the manifold to form said at least one circular input port.

24. The manifold of claim 21 wherein said input end has at least two circular input ports for receiving acoustic power from at least two acoustic drivers, wherein said output end has at least four aligned rectangular output ports, and wherein an acoustic power waveguide is provided for each of said aligned output ports for connecting each of said rectangular output ports to one of said circular input ports such that acoustic power received by said input ports is divided between said acoustic waveguides and such that the acoustic power divided between said acoustic power waveguides is delivered to said aligned rectangular output ports to simulate a line array of at least four acoustic power sources.

25. The manifold of claim 21 wherein said input end has at least two circular input ports for receiving acoustic power from at least two acoustic drivers, wherein said output end has at least two sets of four aligned rectangular output ports, and wherein an acoustic power waveguide is provided for each output port of said two sets of aligned output ports and connects each set of said rectangular output ports to one of said two input ports, such that acoustic power received by said input ports is divided between said acoustic waveguides and such that the acoustic power divided between said acoustic power waveguides is delivered to said two sets of aligned rectangular output ports to simulate a line array of at least eight acoustic power sources.

26. A manifold for delivering acoustic power to the throat end of a horn of a horn loudspeaker, said manifold comprising an input end having at least one circular input port for receiving acoustic power from at least one acoustic driver, an output end for delivering acoustic power to the throat end of the horn, said output end having multiple aligned rectangular output ports, including two outer ports and at least one inner port, which form a line array of rectangular output ports, two outer acoustic power waveguides for connecting the outer ports of said line array of rectangular output ports to said at least one circular input port, said two outer waveguides having substantially straight and approximately equal length acoustical paths and transitioning from a partially circular first end to a rectangular second end, and at least one inner acoustic power waveguide for connecting the at least one inner port of said line array of rectangular output ports to said at least one circular input port, said inner waveguide having a curved acoustical path approximately equal in length to the straight acoustical path lengths of said outer waveguides, and transitioning from a partially circular first end to a rectangular second end, the rectangular second ends of said outer acoustic power waveguides forming the outer ports of said line array of output ports, the rectangular second end of said inner acoustic power waveguides forming the at least one inner port of said line array of output ports, the partially circular first ends of said acoustic power waveguides meeting at the input end of the manifold to form said at least one circular input port, and the acoustic path lengths of said acoustic rower wave guides from said at least one input port to said multiple aligned rectangular output ports being relatively short in relation to the wavelength of the acoustic power passing through the manifold at the highest operating frequency range of the horn loudspeaker.

27. The manifold of claim 26 wherein said line array of output ports includes two inner ports and wherein two inner acoustic waveguides are provided to connect the inner ports of said line array of output ports to said at least one circular input port.

28. The manifold of claim 26 wherein the length of the manifold from the input end to the output end is less than approximately 3 inches.

29. The manifold of claim 26 wherein the length of the manifold from the input end to the output end is approximately 3 inches.

30. The manifold of claim 26 wherein said input end has at least two circular input ports for receiving acoustic power from at least two acoustic drivers, wherein said line array of rectangular output ports includes two outer ports and at least one inner port associated with each circular input port, wherein two outer acoustic power waveguides are provided for each input port for connecting the outer ports of said line array of rectangular output ports to the circular input port with which said outer ports are associated, said outer waveguides having substantially straight and approximately equal length acoustical paths and transitioning from a partially circular first end to a rectangular second end, and wherein at least one inner acoustic power waveguide is provided for each input port for connecting the at least one inner port of said line array of rectangular output ports to the circular input port with which said inner port is associated, said inner waveguides having a curved acoustical path approximately equal in length to the substantially straight acoustical path lengths of said outer waveguides, and transitioning from a partially circular first end to a rectangular second end.

31. A manifold for delivering acoustic power to the throat end of a horn of a horn loudspeaker, said manifold comprising an input end having at least two input ports for receiving acoustic power from at least two acoustic drivers, an output end for delivering acoustic power to the throat end of the horn, said output end having multiple aligned output ports including two outer ports and at least one inner port associated with each input port, said outer and inner ports forming a line array of output ports, two outer acoustic power waveguides for each input port for connecting the outer ports of said line array of output ports to the input port with which the outer ports are associated, said two outer waveguides having substantially straight and approximately equal length acoustical paths, and at least one inner acoustic power waveguide for connecting the at least one inner port of said line array of rectangular output ports to the input port with which said inner port is associated, said inner waveguide having a curved acoustical path approximately equal in length to the substantially straight acoustical path lengths of said outer waveguides, the acoustic path lengths of said acoustic power waveguides from said at least two input ports to said multiple aligned output ports being relatively short in relation to the wavelength of the acoustic power passing through the manifold at the highest operating frequency range of the horn loudspeaker.

32. The manifold of claim 31 wherein the length of the manifold from the input end to the output end is less than approximately 3 inches.

33. The manifold of claim 31 wherein the length of the manifold from the input end to the output end is approximately 3 inches.

34. A method of providing control over the dispersion characteristics of a horn loudspeaker comprising providing loudspeaker horn having an elongated throat opening, providing a source of acoustic power, dividing the acoustic power produced by the acoustic power source between at least two acoustical paths, and propagating the divided acoustic power along the at least two acoustical paths to separate aligned outputs at the elongated throat opening of the horn so as to simulate a line array of acoustic power sources at and in the direction of said elongated throat opening, said acoustical paths being relatively short in relation to the wavelength of the acoustic power delivered to the throat opening of the horn at the highest operating frequency range of the horn loudspeaker.

35. The method of claim 34 wherein acoustical paths for the divided acoustic power have approximately equal acoustic path lengths, such that, the divided acoustic power arrives at the separate aligned outputs at the throat end of the horn approximately in phase.

36. The method of claim 34 wherein the acoustic power from said acoustic power source is divided approximately equally between the at least two acoustical paths.

37. The method of claim 36 wherein the acoustic power from said acoustic power source is divided between multiple acoustical paths extending to multiple aligned outputs at and in the direction of the elongated throat opening of the horn.

38. The method of claim 36 wherein the acoustic power from said acoustic power source is divided between four acoustical paths extending to four aligned outputs at the elongated throat opening of the horn.

39. The method of claim 36 wherein the acoustic power from said acoustic power source is divided between eight acoustical paths extending to eight aligned outputs at and in the direction of the elongated throat opening of the horn.

40. The method of claim 39 wherein said source of acoustic power includes two acoustic drivers and wherein the acoustic power produced by one of said drivers is divided between four of the eight acoustic paths and the acoustic power produced by the other of said drivers is divided between the other four of the eight acoustic paths.

41. The method of claim 34 wherein the acoustical paths increase in cross-sectional area in the direction of propagation of the acoustic power.

42. The method of claim 41 wherein the cross-sectional area of the acoustical paths approximately double from over the length of the paths.

43. A method of providing control over the dispersion characteristics of a horn loudspeaker comprising providing loudspeaker horn having an elongated throat opening, providing a source of acoustic power, dividing the acoustic power produced by the acoustic power source between multiple acoustical paths having approximately equal acoustic path lengths, and propagating the divided acoustic power along the multiple acoustical paths to separate aligned outputs at the elongated throat opening of the horn so as to simulate a line array of acoustic power sources at and in the direction of the elongated throat opening, said multiple acoustical paths being relatively short in relation to the wavelength of the acoustic power delivered to the throat opening of the horn at the highest operating frequency range of the horn loudspeaker.

44. The method of claim 43 wherein the acoustical paths increase in cross sectional area in the direction of propagation of the acoustic power.

* * * * *

UNITED STATES PATENT AND TRADEMARK OFFICE

CERTIFICATE OF CORRECTION

PATENT NO. : 6,668,969 B2 
DATED : December 30, 2003
INVENTOR(S) : John D. Meyer, Perrin Meyer and Richard D. Herr It is certified that error appears in the above-identified patent and that said Letters Patent is hereby corrected as shown below:

Title page,
Add the following:

-- [62] Related U.S. Application Data

Provisional application No. 60/261,113, filed January 11, 2001. --

Signed and Sealed this

Eleventh Day of May, 2004

JON W. DUDAS
*Acting Director of the United States Patent and Trademark Office*